US008834250B2

(12) United States Patent
Kido

(10) Patent No.: US 8,834,250 B2
(45) Date of Patent: Sep. 16, 2014

(54) ROULETTE GAME DEVICE HAVING VARIABLE BETTING TIME LIMIT

(75) Inventor: Katsuhiro Kido, Koto-ku (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 782 days.

(21) Appl. No.: 12/607,611

(22) Filed: Oct. 28, 2009

(65) Prior Publication Data

US 2010/0124966 A1 May 20, 2010

Related U.S. Application Data

(60) Provisional application No. 61/114,804, filed on Nov. 14, 2008, provisional application No. 61/114,805, filed on Nov. 14, 2008.

(51) Int. Cl.

| | |
|---|---|
| ***A63F 9/24*** | (2006.01) |
| ***G07F 17/32*** | (2006.01) |
| ***A63F 5/00*** | (2006.01) |
| *A63F 9/00* | (2006.01) |
| *G07F 17/34* | (2006.01) |

(52) U.S. Cl.

CPC ..... *A63F 5/00* (2013.01); *G07F 17/3269* (2013.01); *G07F 17/322* (2013.01); *A63F 2009/0087* (2013.01); *G07F 17/34* (2013.01); *A63F 5/0082* (2013.01)

USPC ..... 463/17

(58) Field of Classification Search

CPC ..... A63F 5/00; A63F 5/0076; A63F 5/0005; A63F 7/066; G07F 17/3213; G07F 17/3269

USPC ..... 463/17

See application file for complete search history.

(56) References Cited

U.S. PATENT DOCUMENTS

| | | | | |
|---|---|---|---|---|
| 4,869,505 | A * | 9/1989 | Manabe | 463/22 |
| 5,836,583 | A * | 11/1998 | Towers | 273/142 B |
| 5,879,235 | A * | 3/1999 | Kaneko et al. | 463/34 |
| 7,946,912 | B1 * | 5/2011 | Rennard | 463/17 |
| 2003/0060263 | A1 * | 3/2003 | Pearce et al. | 463/17 |
| 2005/0014550 | A1 * | 1/2005 | Rhoten | 463/17 |
| 2005/0255904 | A1 * | 11/2005 | Duhamel | 463/17 |
| 2007/0135203 | A1 * | 6/2007 | Nicely | 463/17 |
| 2009/0174141 | A1 * | 7/2009 | Witty | 273/142 E |
| 2009/0227316 | A1 * | 9/2009 | Grubmuller | 463/17 |

OTHER PUBLICATIONS

U.S. Appl. No. 12/781,343, filed May 17, 2010, Kido.
U.S. Appl. No. 12/781,183, filed May 17, 2010, Kido.

* cited by examiner

*Primary Examiner* — Steve Rowland
(74) *Attorney, Agent, or Firm* — Lexyoume IP Meister, PLLC

(57) ABSTRACT

A roulette game device is configured to make prediction of a game result difficult by making timing at which a bet operation ends variable.

10 Claims, 22 Drawing Sheets

FIG. 23

WHEEL SPEED TABLE

| No. | rpm | No. | rpm |
|---|---|---|---|
| 1 | 6.435 | 21 | 9.056 |
| 2 | 6.554 | 22 | 9.175 |
| 3 | 6.673 | 23 | 9.295 |
| 4 | 6.792 | 24 | 9.414 |
| 5 | 6.911 | 25 | 9.533 |
| 6 | 7.150 | 26 | 9.652 |
| 7 | 7.269 | 27 | 9.771 |
| 8 | 7.388 | 28 | 9.890 |
| 9 | 7.507 | 29 | 10.010 |
| 10 | 7.626 | 30 | 10.129 |
| 11 | 7.745 | 31 | 10.248 |
| 12 | 7.865 | 32 | 10.367 |
| 13 | 7.984 | 33 | 10.486 |
| 14 | 8.103 | 34 | 10.605 |
| 15 | 8.222 | 35 | 10.724 |
| 16 | 8.341 | 36 | 10.844 |
| 17 | 8.460 | 37 | 10.963 |
| 18 | 8.580 | | |
| 19 | 8.818 | | |
| 20 | 8.937 | | |

FIG. 24

CORRESPONDING RELATIONSHIP BETWEEN LATERAL AIR BLOWING TIME AND WAITING TIME

| BLOWING TIME PERIOD | WAITING TIME |
|---|---|
| 2.0sec(MINIMUM) | 0msec |
| 2.1sec | 0msec |
| 2.2sec | 200msec |
| 2.3sec | 400msec |
| 2.4sec | 600msec |
| 2.5sec(MAXIMUM) | 800msec |

ROULETTE GAME DEVICE HAVING VARIABLE BETTING TIME LIMIT

CROSS REFERENCE TO RELATED APPLICATIONS

This application claims benefit of U.S. Provisional Application Nos. 61/114,805 and 61/114,804 respectively filed Nov. 14, 2008, the entire contents of which are incorporated herein by reference.

BACKGROUND OF THE INVENTION

1. Field of the Invention

The present invention relates to a roulette game device.

2. Related Art

In a roulette game device, the player purchases or borrows one or more medals from a medal feeder and starts the game by inserting the medal into the gaming machine. If the player wins the game, a predetermined number of medals are paid out. Therefore, a player who has obtained many medals through this can enjoy the roulette game continuously without purchasing or borrowing new medals.

Here, when a mark (number) arranged on the roulette wheel is selected by a player, the roulette wheel rotates and the ball that has been thrown rolls on the roulette wheel. Then, when the rotation of the roulette wheel slows down and the ball falls into any of the pockets in the roulette wheel, it is determined whether the mark (number) selected by the player and a mark (number) in which the ball is held are matching (winning). Here, when it is determined that the ball is held (win) in a pocket of the same mark (number), medals are paid out to the player at a predetermined rate.

Therefore, in a conventional roulette game device, since a time until betting ends is constant, the time from betting ending until a ball falls in a pocket also tends to be constant. As a result, there is a risk that could become a disadvantage to an amusement facility in that it is possible to predict a game result to a certain degree by determining in which vicinity the ball is revolving immediately before betting is ended.

The present invention addresses such an issue, and thus, it is an object of the present invention to provide a roulette game device that adds difficulty to predicting a location where that ball will fall.

SUMMARY OF THE INVENTION

According to a first aspect of the present invention, a roulette game machine is provided which includes: a roulette wheel on which a plurality of marks is disposed; a ball that rolls on the roulette wheel; a plurality of pockets formed on the roulette wheel in a circumferential direction thereof to correspond to the plurality of marks, and in which the ball falls; a bet device that bets a chip, by way of an operation of a player, on a plurality of bet areas that respectively correspond to the plurality of marks; and a controller that controls the roulette game device, in which the controller performs control to determine an end timing at which a bet operation of the bet device is ended.

According to a second aspect of the present invention, a roulette game machine is provided which includes: a roulette wheel on which a plurality of marks is disposed; a ball that rolls on the roulette wheel; a plurality of pockets formed on the roulette wheel in a circumferential direction thereof to correspond to the plurality of marks, and in which the ball falls; a bet device that bets a chip, by way of a player operation, on a plurality of bet areas that respectively correspond to the plurality of marks; and a controller that controls the roulette game device, in which the controller performs control to arbitrarily change, within a fixed time range, an end of a bet operation in each execution of a roulette game.

According to the second aspect of the present invention, since the timing at which the bet operation is ended is different in each roulette game, for example, prediction no longer can always lead to winning, even by predicting a result of a roulette game based on conditions immediately before the bet operation is ended. In this way, it becomes possible to provide a roulette game device that adds difficulty to predicting a location at which the ball falls.

According to a third aspect of the present invention, further to the roulette game device described in the second aspect, the roulette game device includes: a bank path that is provided to be endless and surround an outer circumferential edge side relative to the pockets of the roulette wheel, and on which the ball revolves; a compressor that compresses air; and a discharge opening that discharges air that has been compressed by the compressor along a revolution direction of the ball on the bank path, in which the controller performs control to eject air from the discharge opening to the ball, and to change an ejection time of air onto the ball in each execution of the roulette game.

According to a fourth aspect of the present invention, further to the roulette game device described in the third aspect, the controller performs control to delay the end of the bet operation in response to the ejection time.

According to a fifth aspect of the present invention, further to the roulette game device described in the second aspect, the controller performs control to arbitrarily change a rotation speed of the roulette wheel within a fixed speed range in each execution of the roulette game.

According to a sixth aspect of the present invention, a roulette game device is provided which includes: a roulette wheel on which a plurality of marks is disposed; a ball that rolls on the roulette wheel; a plurality of pockets formed on the roulette wheel in a circumferential direction thereof to correspond to the plurality of marks, and in which the ball falls; a bank path that is provided to be endless and surround an outer circumferential edge side relative to the pockets of the roulette wheel, and on which the ball revolves; a bet device that bets a chip, by way of an operation of a player, on a plurality of bet areas that respectively correspond to the plurality of marks; a detection sensor that detects the ball revolving around the bank path; and a controller that controls the roulette game device, in which the controller performs control to determine an end timing at which a bet operation of the bet device is ended, based on a revolution speed of the ball from detection results of the detection sensor.

According to the sixth aspect of the present invention, it is possible to predict a timing at which the ball falls by monitoring the revolution speed of the ball using the detection sensor provided in the bank path. In this way, it is possible to provide a roulette game device in which a bet can be placed until immediately before the ball falls, and thus it is possible to offer amusement that is close to that in an actual roulette game as well as invoke in a player an expectation of easily winning.

According to a seventh aspect of the present invention, further to the roulette game device described in the sixth aspect, the controller estimates a remaining number of revolutions until a state is entered in which the ball easily moves from the bank path to a side of the roulette wheel, based on the revolution speed of the ball, and performs control to end a bet operation at the bet device, when the remaining number of revolutions becomes a predetermined number of times.

According to an eighth aspect of the present invention, further to the roulette game device described in the seventh aspect, the roulette game device further includes an input device that designates the predetermined number of times by way of an external operation.

According to a ninth aspect of the present invention, further to the roulette game device described in the sixth aspect, the controller performs control to store data related to the revolution speed in memory, each execution of a roulette game, to request a temporal change of the revolution speed based on data stored in the memory, and to adjust the end timing of the bet operation according to the temporal change of the revolution speed.

According to a tenth aspect of the present invention, further to the roulette game device described in the sixth aspect, the controller performs control to arbitrarily change, within a fixed time range that begins a predetermined time before the end timing of the bet operation, a timing to begin a notification that the end timing of the bet operation is soon in each execution of a roulette game, when performing control to perform the notification.

BRIEF DESCRIPTION OF THE DRAWINGS

FIG. 23 is an illustrative diagram showing a wheel speed table used for setting rotation speed of the wheel; and FIG. 24 is an illustrative diagram showing operation of a corresponding relationship between a lateral air blowing time period and a waiting time.

DETAILED DESCRIPTION OF THE INVENTION

In the following, a roulette game device of the present invention is described in detail with reference to drawings. Although a roulette game device of the present invention is described below, in summary, the roulette game is configured so that a player can place a bet until immediately before a ball 11 falls by monitoring a revolution speed of the ball using ball revolution sensors 570 and 580 provided at a bank path so as to predict the timing of the ball falling. Accordingly, the roulette game device makes prediction to win difficult by making timing at which a bet operation ends variable, while making prediction of a game result seem easy.

A roulette game device is a gaming machine in which a player predicts a number or the like determined in a roulette device, and bets game media such as medals that the player possesses on the number or the like predicted. Then, when the number or the like on which a bet is placed has won, the player can receive from the gaming machine a predetermined number of medals paid out.

Figure 1:
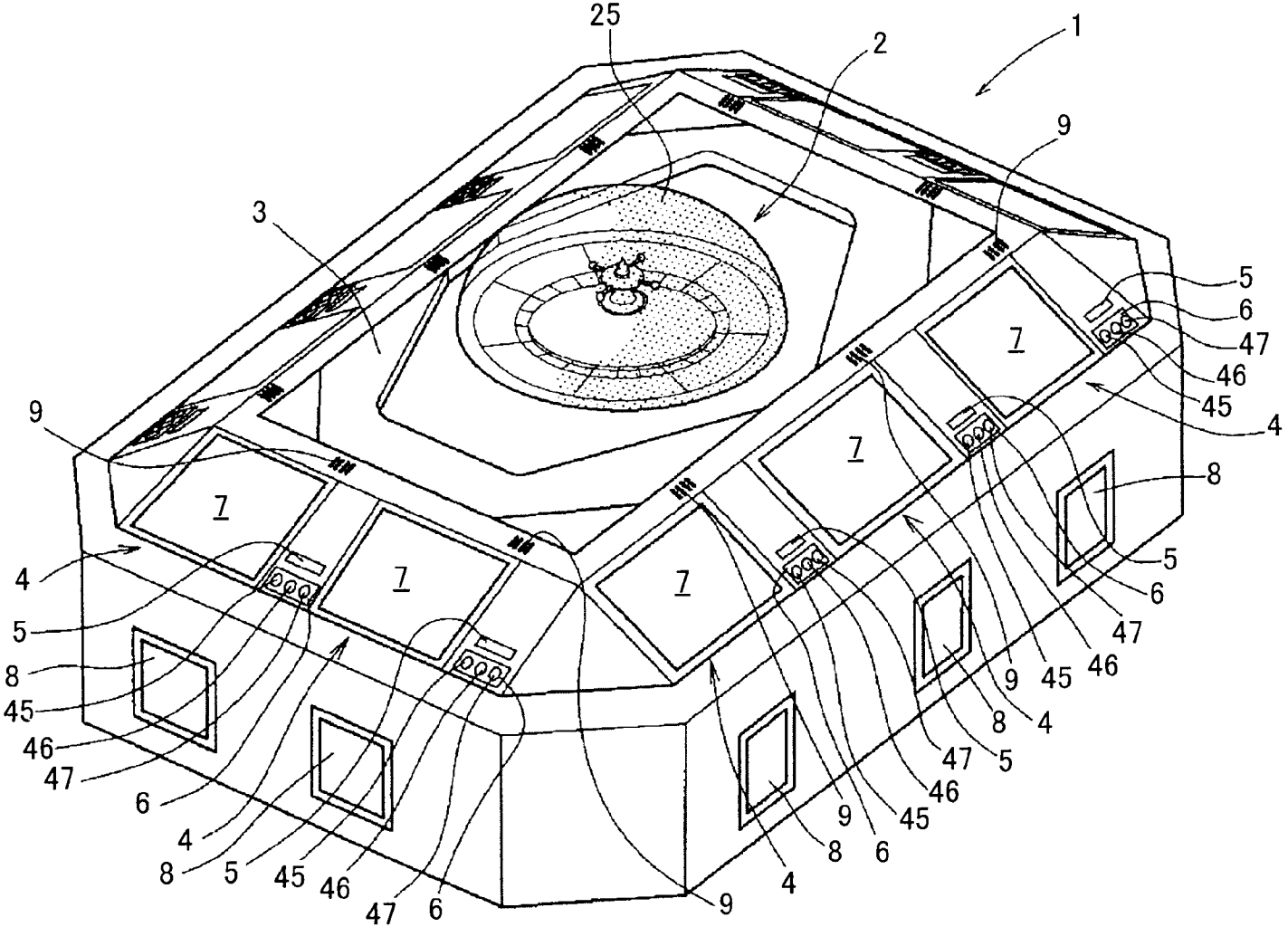
FIG. 1 is a perspective view showing an external view of a roulette game device according to the present invention.

FIG. 1 is an external perspective view showing a schematic configuration of a roulette game device. As shown in FIG. 1, the roulette game device 1 mainly includes a cabinet 3 as a main body, a roulette device 2 disposed substantially at a central portion of an upper face of the cabinet 3, and a plurality of satellites 4 (for example, 10 satellites) that are disposed so as to surround the roulette device 2 at a periphery of the roulette device 2.

Here, the satellites 4 are gaming areas that at least include a medal insertion opening 5 to which game media such as currency or medals to be used for playing the game are inserted, a control unit 6, which is configured with a plurality of control buttons and the like to which a predetermined instruction is inputted by the player, and an image display unit 7 that allows an image related to a game to be displayed. Then, the player may advance a game by operating the control unit 6 or the like while viewing the image displayed on the image display unit 7.

In addition, a medal payout opening 8 is disposed on a side face of the cabinet 3 at which each satellite 4 is disposed. Moreover, a speaker 9 conveying music, sound effects, or the like is disposed on the upper right of the image display unit 7 of each satellite 4.

Then, a medal sensor (not illustrated) is disposed inside the medal insertion opening 5, and performs identification of game media such as medals inserted via the medal insertion opening 5, as well as counts the number of medals thus inserted. In addition, a hopper (not illustrated) is disposed inside the medal payout opening 8 and a predetermined number of medals is paid out from the medal payout opening 8.

Figure 2:
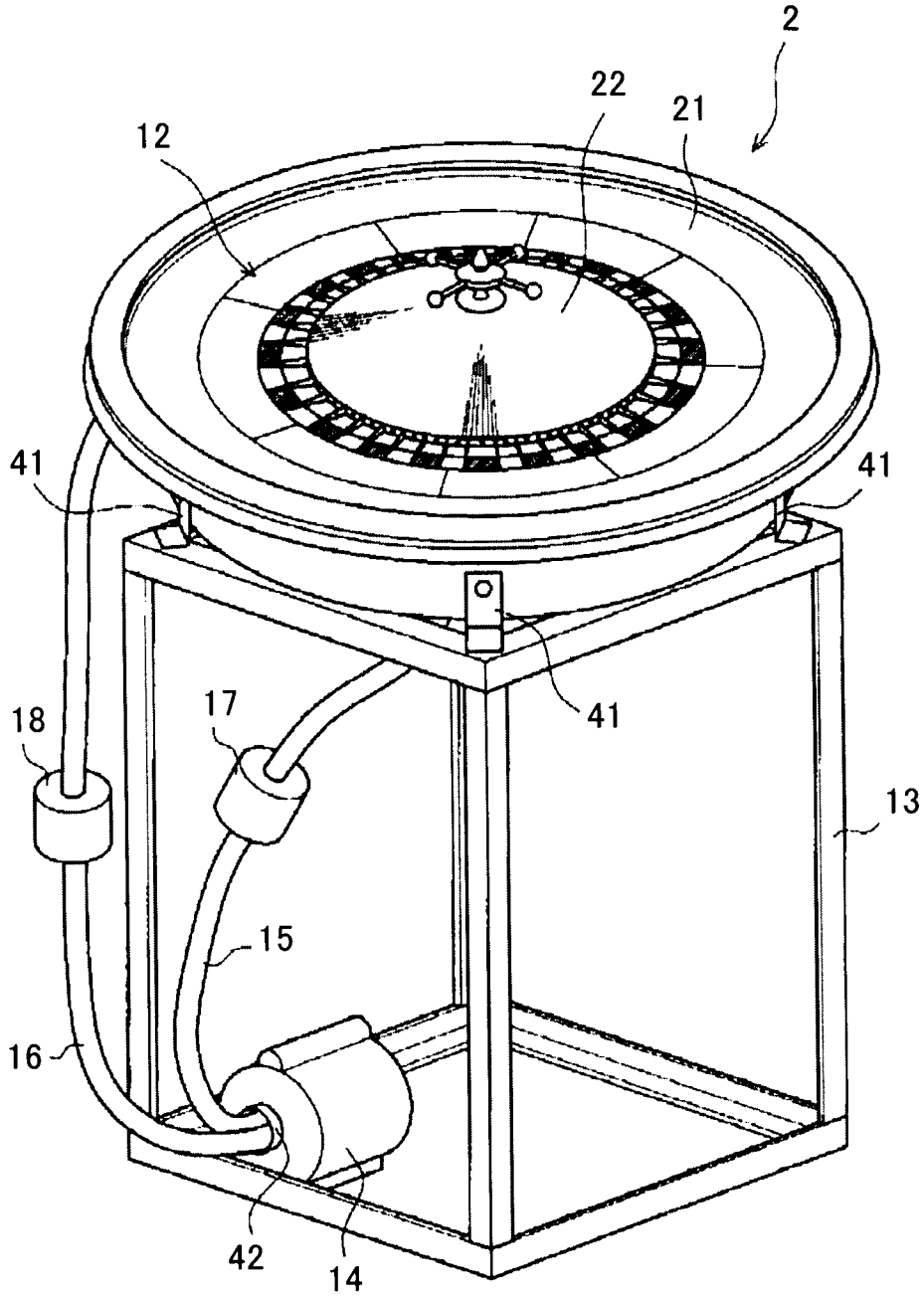
FIG. 2 is a perspective view showing a lower configuration of the roulette game according to the present embodiment.
Figure 3:
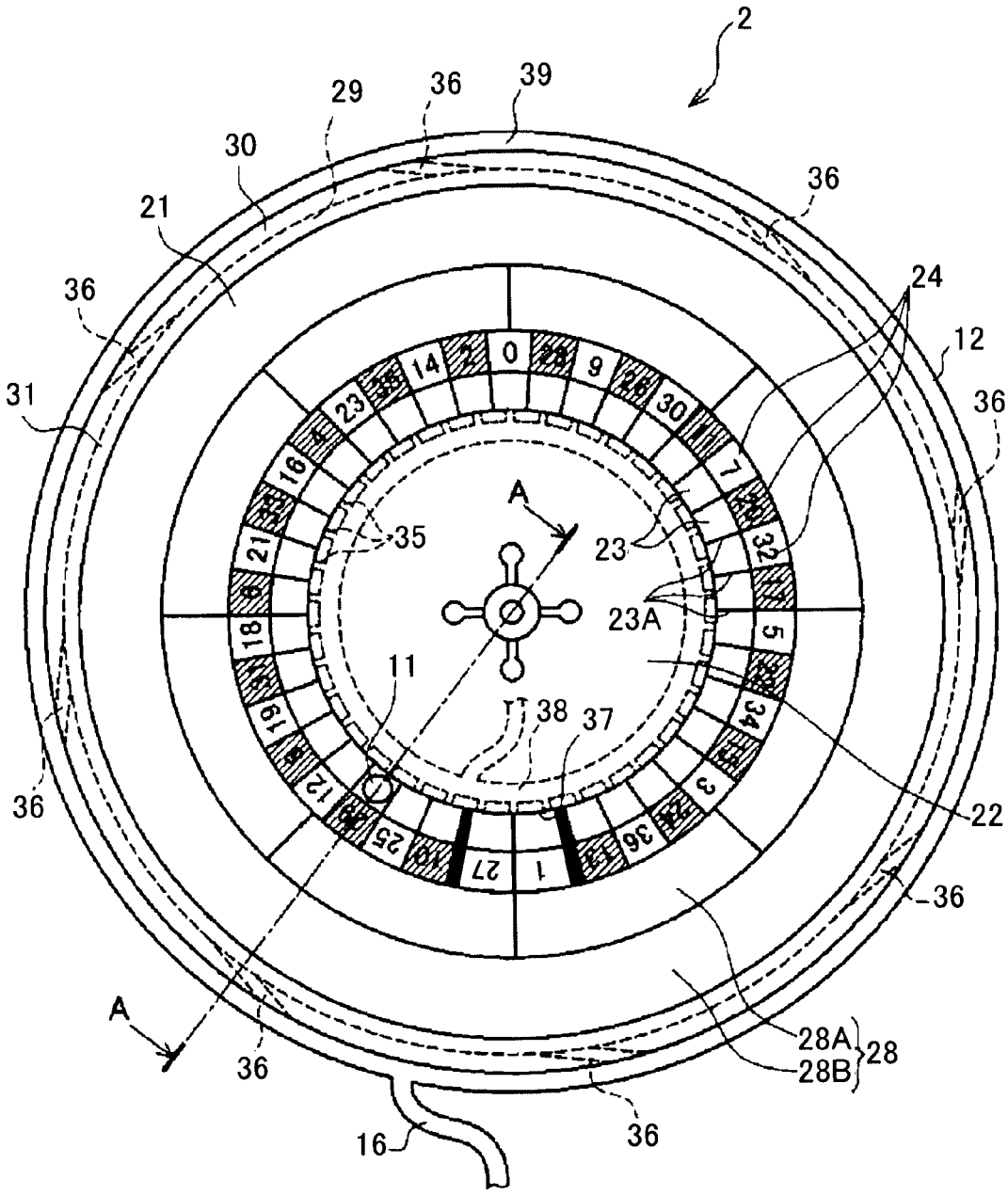
FIG. 3 is a plan view showing a face of the roulette game device according to the present embodiment.
Figure 4:
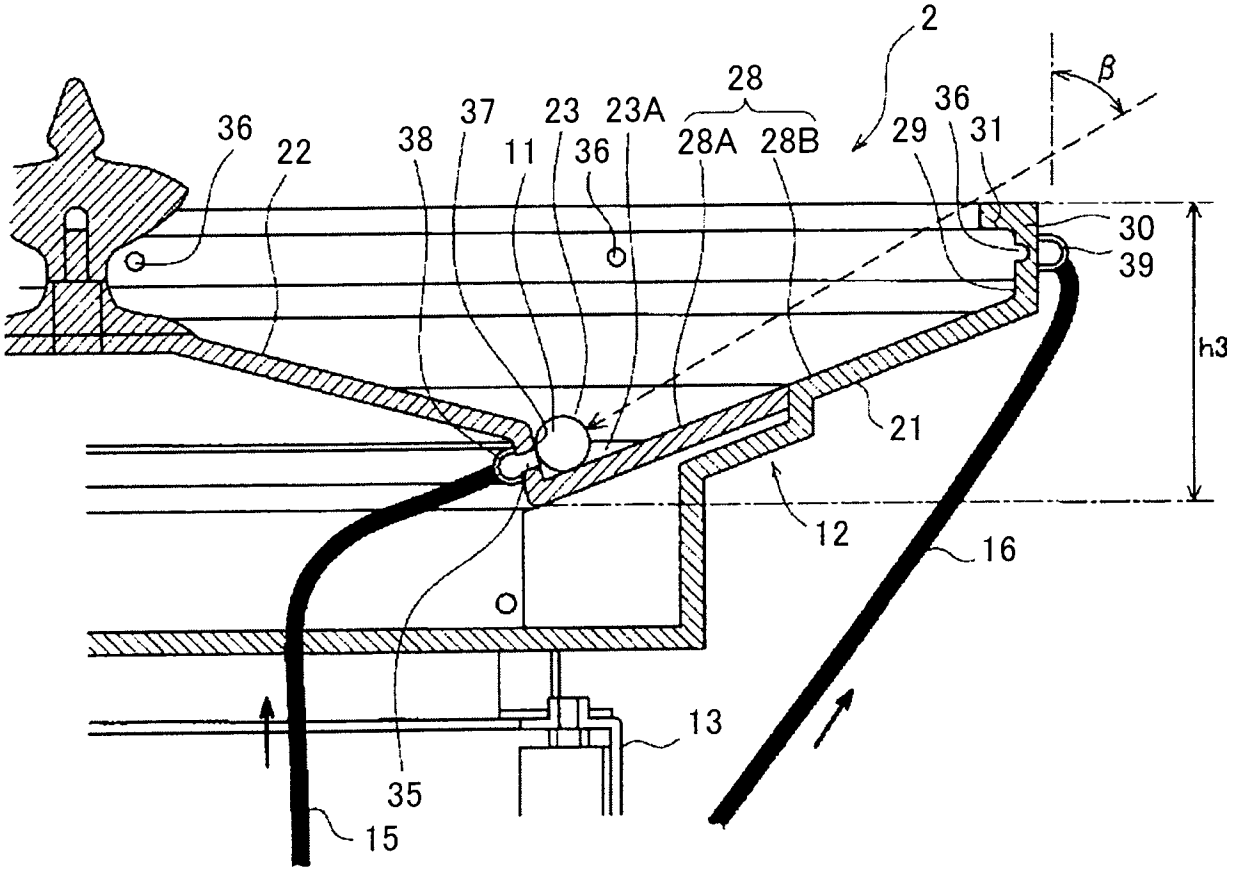
FIG. 4 is a side view showing an internal configuration in the vicinity of a discharge opening of air of the roulette game device according to the present embodiment.
Figure 5:
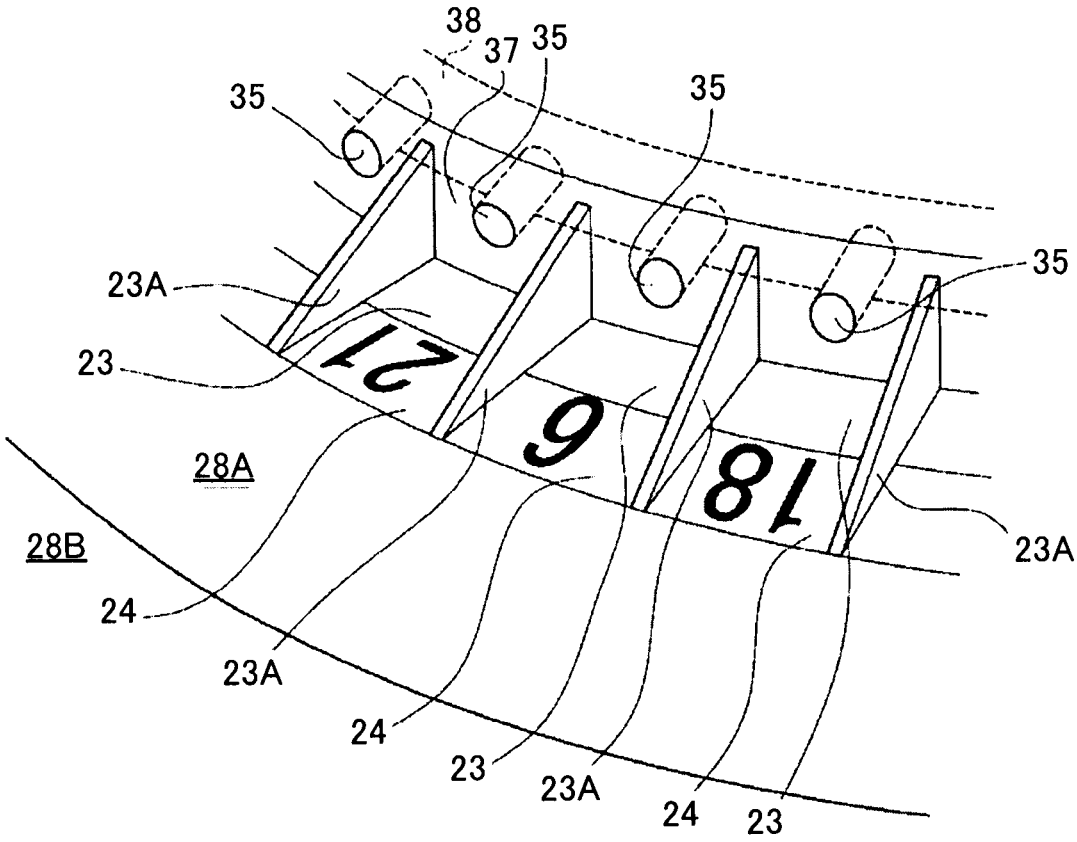
FIG. 5 is a perspective view showing an external appearance in the vicinity of a pocket of the roulette game device according to the present embodiment.
Figure 6:
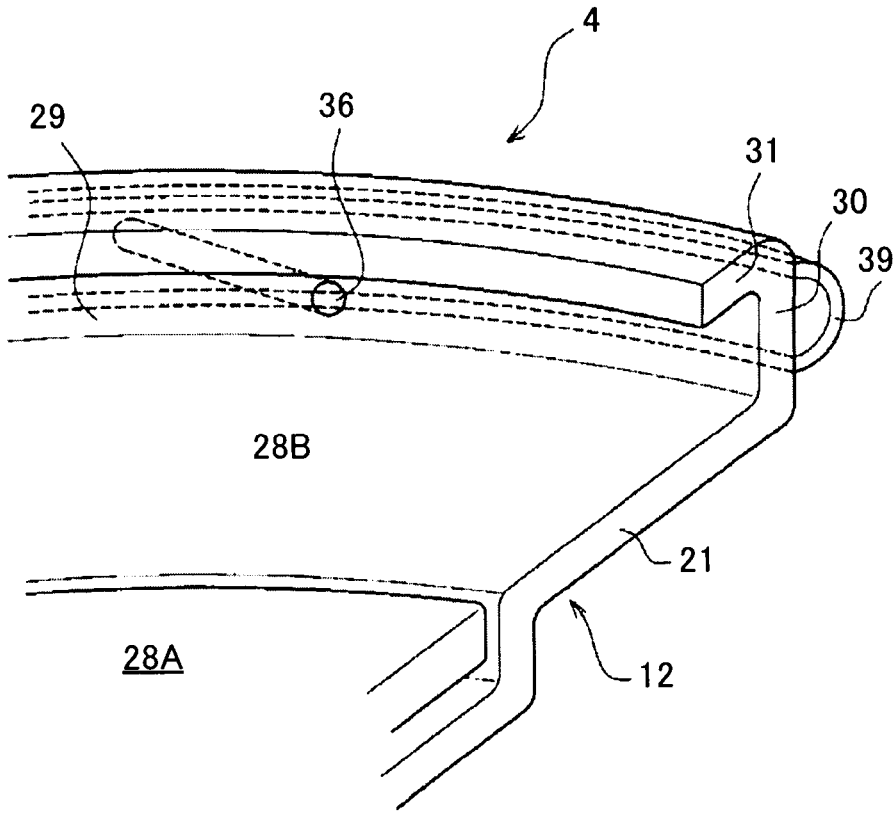
FIG. 6 is an illustrative diagram showing a configuration in the vicinity of a bank path of the roulette game device according to the present embodiment.

Next, a configuration of the roulette device 2 is described with reference to FIGS. 2 to 6. FIG. 2 is a perspective view showing the roulette device, FIG. 3 is a plan view showing the roulette device, and FIG. 4 is a cross-sectional view of the roulette device along the line A-A in FIG. 3. FIG. 5 is a perspective view in which the vicinity of a pocket of the roulette device is shown to be enlarged. FIG. 6 is a perspective view in which the vicinity of a bank path of the roulette device is shown to be enlarged.

As shown in FIG. 2, the roulette device 2 mainly includes a roulette wheel 12 having a rolling area in which a ball 11 rolls in a game, a support rack 13 that supports the roulette wheel 12 inside the roulette game device 1, a compressor 14 that takes in and compresses ambient air to a predetermined pressure, air tubes 15 and 16 that transfer air compressed by the compressor 14, and a first open-close valve 17 and a second open-close valve 18 that are provided in middle points of the air tubes 15 and 16, respectively, and adjust the air pressure.

In addition, the roulette wheel 12 mainly includes a frame body 21 that is fixed at the support rack 13 and a wheel 22 that is rotatably held and supported inside the frame body 21. Then, the wheel 22 has a number of pockets 23 (for example, 37 pockets) formed in the shape of recesses on the upper face of the wheel 22. Each of the pockets 23 is divided by a partitioning wall 23A of a substantially triangular shape (see FIG. 5), and furthermore, marks 24 in which each number from "0" and "1" to "36" is respectively displayed as a graphic figure are formed at the outer side of the respective pockets 23 on the upper face of the wheel 22. Then, over a period from immediately after the ball 11 begins to roll until a predetermined time period elapses after the ball 11 has fallen into a pocket 23, the wheel 22 is caused to rotate in a predetermined direction with respect to the frame body 21 (for example, in a clockwise direction) and at a predetermined speed (for example, 2p [rad/s] to 0.2p [rad/s]) by a drive motor (not illustrated) provided inside the roulette device 2.

Furthermore, in a case of being disposed at the roulette game device 1, the entire upper area above the roulette wheel 12 is covered with a transparent acrylic cover member 25 formed in a hemispherical shape (see FIG. 1). Thus, it is possible to maintain the ball 11 so that the ball 11 revolving on the roulette wheel 12 in a game does not jump out to the outside of the roulette wheel 12. In addition, a foreign material is prevented from intruding, thereby making it so that fraudulence cannot be done.

Here, a rolling area where the ball actually rolls on the roulette wheel 12 is composed of a single inclined face 28 with a predetermined angle (for example, 15 degrees) formed by a first inclined face 28A that is formed at an outer circumferential edge side of the frame body 21 and a second inclined face 28B that is formed at an inner circumferential edge side of the wheel 22. The inclined face 28 is inclined upward along the direction from the center to the circumference of the roulette wheel 12, and the pocket 23 and a bank path (described later) are formed continuously via the inclined face 28.

Furthermore, the bank path 29 is provided at an outer circumferential edge portion of the frame body 21. The bank path 29 guides the ball 11 against centrifugal force of the ball 11 rolling on the roulette wheel 12 and is a path that causes the ball 11 to roll so as to follow a circular track. In addition, the bank path 29 is formed in an endless fashion with respect to the roulette wheel 12 by way of a guiding wall 30 which is installed upright in a vertical direction, and furthermore, a wall portion 31 is formed to be continuous with the bank path 29 at an upper edge, which is an outer circumferential portion thereof. The wall portion 31 is a member that biases the ball 11 revolving on the bank path 29 inwardly so as not to jump to the outside of the roulette wheel 12.

Then, the ball 11 to which an accelerating force has been applied by air discharged from a first discharge opening 35 and a second discharge opening 36 (described later) increases speed gradually and rotationally moves along the bank path 29. On the other hand, when discharge of the air from the second discharge opening 36 is stopped, the revolution speed of the ball 11 decreases, and thus the ball 11 loses centrifugal force, rolls and falls on the inclined face 28, goes to the inside of the roulette wheel 12, and reaches the wheel 22 that is rotating. Then, the ball 11, which has rolled into the wheel 22, passes through on the marks 24 of the wheel 22, which is rotating, and falls into any one of the pockets 23, and thus the number depicted on the mark 24 corresponding to the pocket 23 in which the ball 11 falls becomes a winning number.

Figure 7:
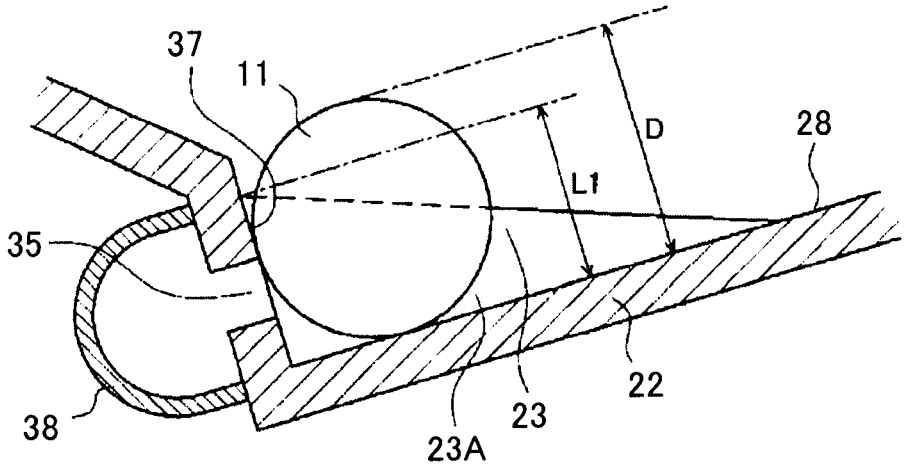
FIG. 7 is a side view showing an internal configuration in the vicinity of a discharge opening of air of the roulette game device according to the present embodiment.

On the other hand, the depth L1 of the pocket 23 with respect to the inclined face 28 is arranged so as to be shallower than the diameter D of the ball 11. FIG. 7 is a schematic diagram showing a pocket. As described above, the pocket 23 is a space that is divided into 38 parts in a circumferential direction by the partitioning walls 23A and holds the ball 11. Then, since it is configured so that the depth L1 of the pocket 23 is shallower than the diameter D of the ball 11, as shown in FIG. 7, when the ball 11 falls in the pocket 23, it is unlikely that the ball 11 will become buried in the pocket 23, and thus it is possible for the player to easily recognize the location at which the ball 11 fell in the pocket 23 in a game. Accordingly, game playability is improved.

Furthermore, the roulette device 2 can repeatedly roll the ball 11 without having to recover it from the roulette wheel 12 by discharging compressed air to the ball 11. Therefore, a complex mechanism such as a launching unit and a movable unit for recovering the ball 11 is not necessary. In addition, the depth L1 of the pocket 23 can be shorter than the diameter D of the ball 11 (see FIG. 7). This can lower the height h3 of the roulette wheel 12 as shown in FIG. 5. Thus, it is possible to widen a viewing angle b of the roulette device 2 for recognizing the ball 11 and facilitate the player's recognition of the ball, whereby game playability is improved.

Moreover, since the pocket 23 and the bank path 29 are formed continuously as the single inclined face 28 that is inclined upward from the pocket 23 to the bank path 29 at a predetermined inclined angle, the player can easily recognize the ball 11 held in the pocket 23.

Next, a first discharge opening 35 and a second discharge opening 36 that are disposed at the roulette wheel 12 are described with reference to FIGS. 5 and 6. Here, the roulette device 2 uses air pressure of compressed air as a power source when pushing the ball 11 on the roulette wheel 12. More specifically, the compressor 14 (see FIG. 2) disposed below the roulette device 2 takes in ambient air and compresses it to a predetermined pressure (for example, 1 Mpa), and delivers the compressed air to the roulette wheel 12 via the air tubes 15 and 16. Then, by discharging it by way of the first discharge opening 35 and the second discharge opening 36, a force by the air pressure is applied to the ball 11 in the roulette wheel 12.

As shown in FIG. 5, the first discharge opening 35 is formed at an inner side wall 37 that, along with the partitioning wall 23A, forms the pocket 23 and is formed so as to correspond to each of the pockets 23. For example, 37 pockets 23 that respectively correspond to each number "0", "1" to "36" are formed, and thus the first discharge openings 35 are formed at 37 locations. In addition, the first discharge openings 35 are formed to be directed from the center to the circumferential direction of the roulette wheel 12, and the air discharged from the first discharge opening 35 is emitted toward the bank path 29 disposed at the outer circumferential edge portion of the roulette wheel 12.

On the other hand, a toric air pipe for launching 38 is disposed on a back side face of the inner side wall 37 on which the first discharge opening 35 is formed. The air pipe for launching 38 is connected with the air tube 15, and the first discharge openings 35 are formed at 37 locations on the circumference. Therefore, the air delivered from the air tube 15 once flows into the air pipe for launching 38, and is then discharged simultaneously from the first discharge openings 35 disposed at 37 locations to the pocket 23. Then, according to the air pressure of the air thus discharged, the ball 11 held in any one of the pockets 23 starts to roll toward the bank path 29 against the inclination of the inclined face 20.

Furthermore, as shown in FIG. 6, the second discharge opening 36 is formed at the guiding wall 30 that configures the bank path 29 with a predetermined interval (for example, a 45 degree interval). In addition, the second discharge opening 36 is formed to be oriented in a circumferential direction of the bank path 29, that is, a tangential direction of the roulette wheel 12, and the air discharged from each of the second discharge openings 36 produces a layer of air which flows in a clockwise direction along the bank path 29 of the roulette wheel 12.

On the other hand, a toric air pipe for revolution 39 is disposed on a back side face of the guide wall 30 on which the second discharge opening 36 is formed. The air pipe for revolution 39 is connected with the air tube 16, and the air delivered from the air tube 16 flows in the air pipe for revolution 39 and is discharged simultaneously from the second discharge opening disposed at 8 locations. Thus, the ball 11 that rolls into the bank path 29 based on the air discharged from the first discharge opening 35 starts to roll in a clockwise direction by the layer of the air flowing circularly along the bank path 29.

Furthermore, when stopping the discharge of the air from the second discharge opening 36, the layer of the air formed along the bank path 29 dissipates, and the revolution speed of the ball 11 decreases gradually and loses centrifugal force. Then, the ball 11 rolls and falls along the inclination of the inclined face 28 toward the inside of the roulette wheel 12 and reaches the wheel 22, which is rotating. Then, the ball 11 falls in any one of the pockets 23 that is formed on the wheel 22. Thus, a winning number is determined by the roulette device 2, and the roulette game device 1 pays out medals based on the number thus determined and bet information related to the player's bet and ends the game.

Furthermore, afterward, upon discharging the air from the first discharge opening 35, the ball 11 held in the pocket 23 starts to roll again, and thus it is possible to perform subsequent games continuously.

From the above, it is possible to cause the ball 11 to roll and then fall into a pocket 23 repeatedly without recovering the ball 11 from the roulette wheel 12, by applying a force to the ball 11 by the air pressure of air discharged from the first discharge opening 35 and the second discharge opening 36. Accordingly, a complex mechanism such as a launching unit and a movable unit for recovering the ball 11 is not necessary, and it is possible to facilitate maintenance and reduce costs.

In addition, the support rack 13 is a rack in substantially a rectangular shape that is formed by combining a plurality of columns made of metal, and fixes the roulette wheel 12 at a predetermined height by way of fixtures 41 which are provided at total of 4 locations at the corners of the upper face.

Furthermore, the compressor 14 is disposed in an internal space that is formed in the support rack. The compressor 14 takes in ambient air and compresses it to a predetermined pressure (for example, 1 Mpa). In addition, the compressor 14 includes two discharge nozzles 42 that discharge compressed air, and the air tubes 15 and 16 are connected thereto, respectively.

As described above, the air tubes 15 and 16 are tubes that deliver the air compressed by the compressor 14 to the first discharge openings 35 and the second discharge openings 36 formed on the roulette wheel 12, and a first open-close valve 17 and a second open-close valve 18 are provided at intermediate locations thereof. The first open-close valve 17 and the second open-close valve 18 are electromagnetic valves and configured so as to adjust a time period for which the valves open. Then, the first open-close valve 17 and the second open-close valve 18 are connected to a main control CPU 80 (see FIG. 13), and the main control CPU 80 controls an open-close time according to a program stored in the ROM 81 in advance (described later). Thus, the CPU 80 performs a series of operations of adjusting air pressure discharged from the first discharge opening 35 and the second discharge opening 36, causing the ball 11 to roll on the roulette wheel 12, and causing the ball 11 to fall into a pocket 23 after a predetermined lapse of time.

Figure 8:
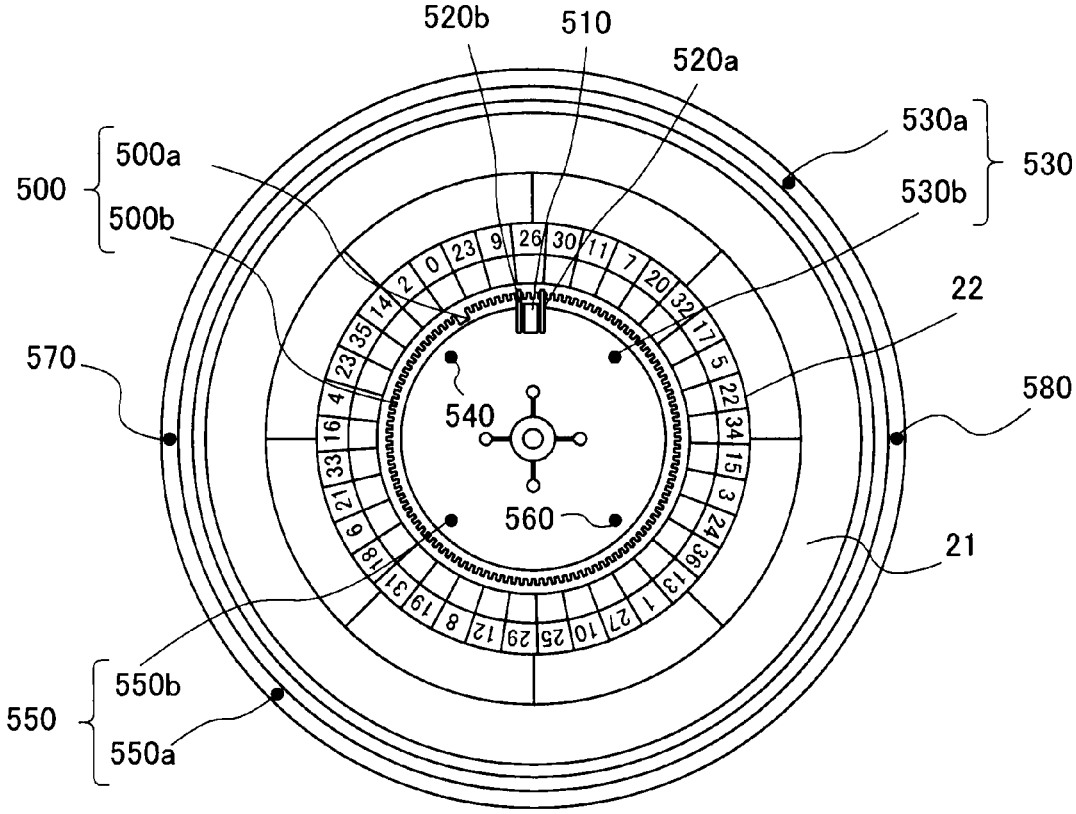
FIG. 8 is an illustrative diagram showing an arrangement of various sensors in the roulette game device according to the present embodiment.

FIG. 8 is a plan view showing a lower configuration of the wheel 22 and an arrangement of various sensors. As shown in FIG. 8, a sequential convex and concave portion 500 is formed at an inner circumference of the wheel 22 and, more specifically, a convex portion 500*a*, which is larger than the rest 500*b*, is formed at a position corresponding to "0". In addition, an origin position sensor 510 is provided so as to face the convex and concave portion 500, and pocket position sensors 520*a* and 520*b* are provided at the both side portions of the origin position sensor 510. In the present embodiment, the position "0" is defined as an origin position, and the convex portion 500*a* is formed at the position "0". When the origin point sensor 510 detects the convex portion 500*a* passing, it is possible to monitor the origin position. In addition, the pocket position sensors 520*a* and 520*b* detect a convex portion in the convex and concave portion 500, and it is possible to monitor the rotating position of the roulette wheel 12 based on a number of detections of the convex portion by the pocket position sensors 520*a* and 520*b* after the origin position sensor 510 detects the origin position.

Furthermore, two transmission sensors 530 and 550 are provided so as to be in symmetrical positions to each other with respect to the center of the wheel 22, and two reflective sensors 540 and 560 are provided at 90 degree positions with respect to the two transmission sensors 530 and 550. That is, the transmission sensor 530, the reflective sensor 540, the transmission sensor 550, and the reflective sensor 560 are disposed at 90 degree positions to each other in this order in a clockwise direction.

The reflective sensors 540 and 560 include a light emitting element and a light receiving element, and the light emitting element faces in an emission direction with respect to the center of the wheel 22. Then, when the ball 11 held in the pocket 23 passes through the position facing the light emitting device, the ball 11 reflects the light from the light emitting device, and thus passing of the ball 11 is detected by the light receiving element receiving the light reflected at this time.

The transmission sensors 530 and 550 include the light emitting elements 530*a* and 550*a*, and the light receiving elements 530*b* and 550*b*, in which the light emitting devices 530*a* and 550*a* are disposed at an outer circumferential portion of the frame body 21, and the light receiving elements 530*b* and 550*b* are disposed below the wheel 22. In addition, the light emitting elements 530*a* and 530*b*, and the light emitting element 550*a* and the light receiving element 550*b* are respectively disposed on an identical line in an emission direction with respect to the center of the wheel 22. Then, by the light receiving element detecting that the ball 11 interrupted the light from the light emitting element when the ball 11 held in the pocket 23 passes through the position facing the light emitting device, passing of the ball 11 is detected.

Moreover, by specifying the rotating positions of the roulette wheel 12 at the time when the transmission sensor 530, the reflective sensor 540, the transmission sensor 550, and the reflective sensor 560 detect the ball, respectively, it is possible to determine which pocket 23 corresponds to any one of the marks 24 the ball 11 falls in. In addition, regions on optical paths of at least the transmission sensors 530 and 550 and the reflective sensors 540 and 560 in the wheel 22 are formed by a light transmission member so that the light emitting elements 530*a* and 550*a* can reach the light receiving elements 530*b* and 550*b* or the light reflected from the ball 11 can reach the reflective sensors 540 and 560.

To describe in detail the method of determining the pocket 23 in which the ball 11 fell, there are two types of detection patterns for the ball 11, with one being from the transmission sensor to the reflective sensor and the other being from the reflective sensor to the transmission sensor. In the present invention, a mark that corresponds to the ball 11 is fixed when the ball 11 passes through the two reflective sensors. That is, in a case in which the transmission sensor detects the ball 11 first, the mark is fixed when the reflective sensor, the transmission sensor, and the reflective sensor detect the ball 11 subsequently. In a case in which the reflective sensor detects the ball 11 subsequently, the mark is fixed when the transmission sensor and the reflective sensor detect the ball 11. Thus, the mark is fixed after the ball 11 falls in the pocket 23 and before the wheel 22 revolves one time. In addition, in a case in which there arises an irregular reaction from the transmission sensors 530 and 550 and the reflective sensors 540 and 560, for example, in a case in which a detection signal is outputted in the order of the transmission sensor and then the transmission sensor, in a case in which a detection timing in the order of the reflective sensor, the transmission sensor, and then the reflective sensor is not clearly uniform, and in a case in which the reflective sensor detects the ball 11 immediately after the launching of the ball 11, it is configured not to fix the mark corresponding to any one of the pocket 23 in which the ball 11 fell in. As causes of such errors, for example, several cases can be considered in which another ball is thrown and the number of balls becomes multiple, the ball once fell in a pocket 23 and then moved to another pocket 23, the ball fell in a pocket 23 by air being discharged in a wrong direction due to a foreign material being stuck in the discharge opening of the air, and the like. In a case in which an irregular reaction of the transmission sensors 530 and 550 and the reflective sensors 540 and 560 arises in each rotation and continues for more than one rotation, for example, error processing such as removing the ball when multiple balls exist, is performed according to the phenomenon causing the error.

In addition, ball revolution sensors 570 and 580, which detect the ball 11 revolving inside the frame body 21, are provided at the circumferential portion of the frame body 21. The ball revolution sensors 570 and 580 are reflective sensors that are disposed at a symmetrical position with respect to the center of the wheel 22. Then, it is possible to monitor the revolution speed of the ball 11 revolving inside the frame body 21 by measuring the time during which the ball revolution sensor 570 detects the ball 11 and then the ball revolution sensor 580 detects the same.

Next, a configuration of a control unit 6 and an image display device 7 is described. As illustrated in FIG. 1, the control unit 6 is provided at a side of the image display unit 7 shown in FIG. 1 and includes buttons operated by a player. More specifically, a bet selection button 45, a payout (cash-out) button 46, and a help button 47 are provided in order, starting from the left as viewed from a position facing the satellite 4.

The bet selection button 45 is a button provided for a player to press so as to confirm betting through the image display unit 7 (described later) after a bet operation is completed. Then, betting is confirmed, and in a case in which a bet is placed on the mark 24 that corresponds to the pocket 23 in which the ball 11 fell in at the roulette device 2 in a game, the player wins an award. When the player wins an award, credit corresponding to the number of chips bet is added to the current credit of the player.

The payout button 46 is a button which is usually pressed at the end of a game. When the payout button 46 is pressed, medals corresponding to the current credit (normally, 1 medal for 1 credit) that the player has acquired through the game is paid out from the payout slot 8.

The help button 47 is a button that is pressed in a case where a method of operating the game is unclear, and upon the help button 47 being pressed, a help screen showing various kinds of operation information is displayed immediately thereafter on the image display unit 7.

Figure 9:
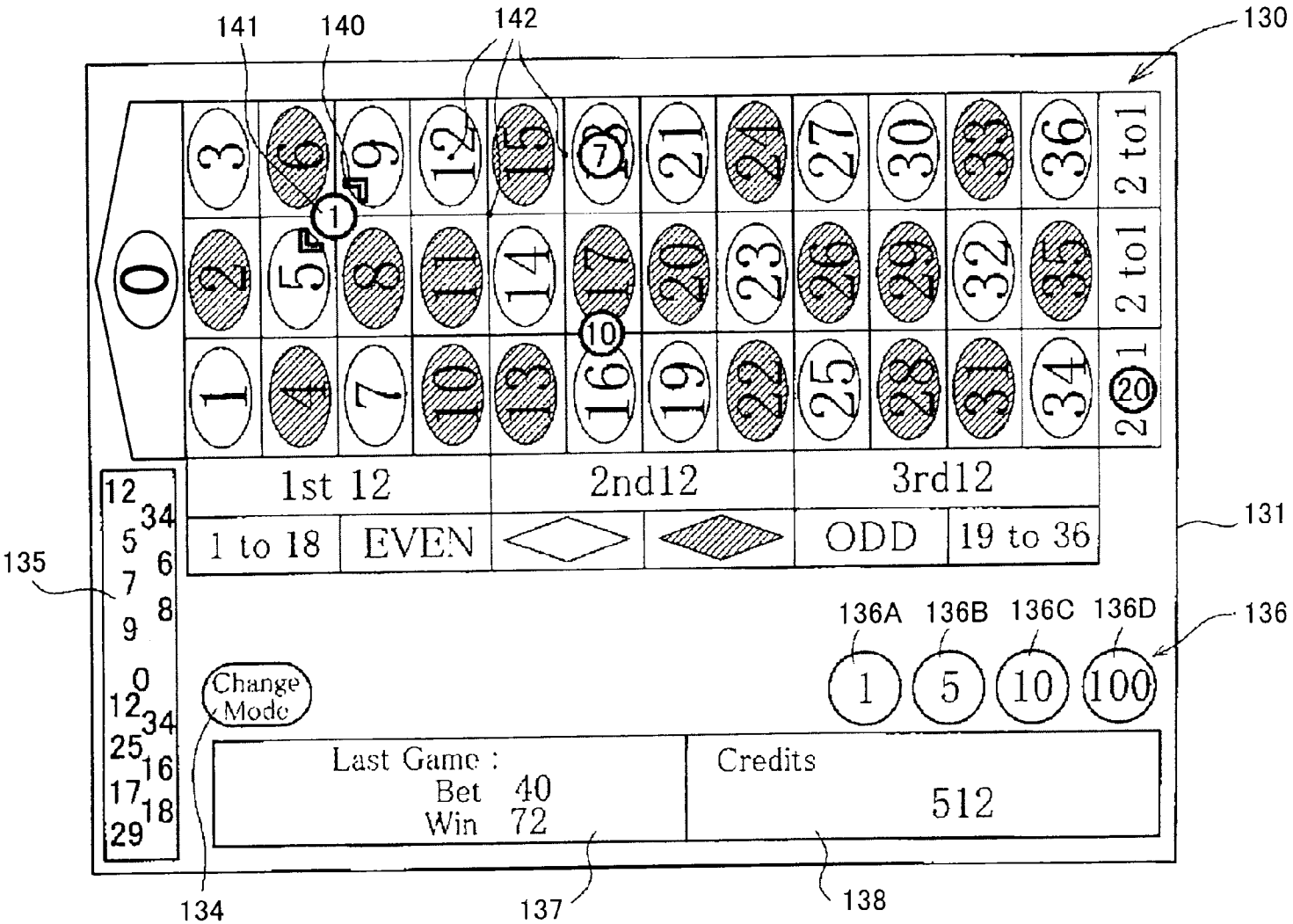
FIG. 9 is an illustrative diagram showing a bet screen of a table-type betting board.
Figure 10:
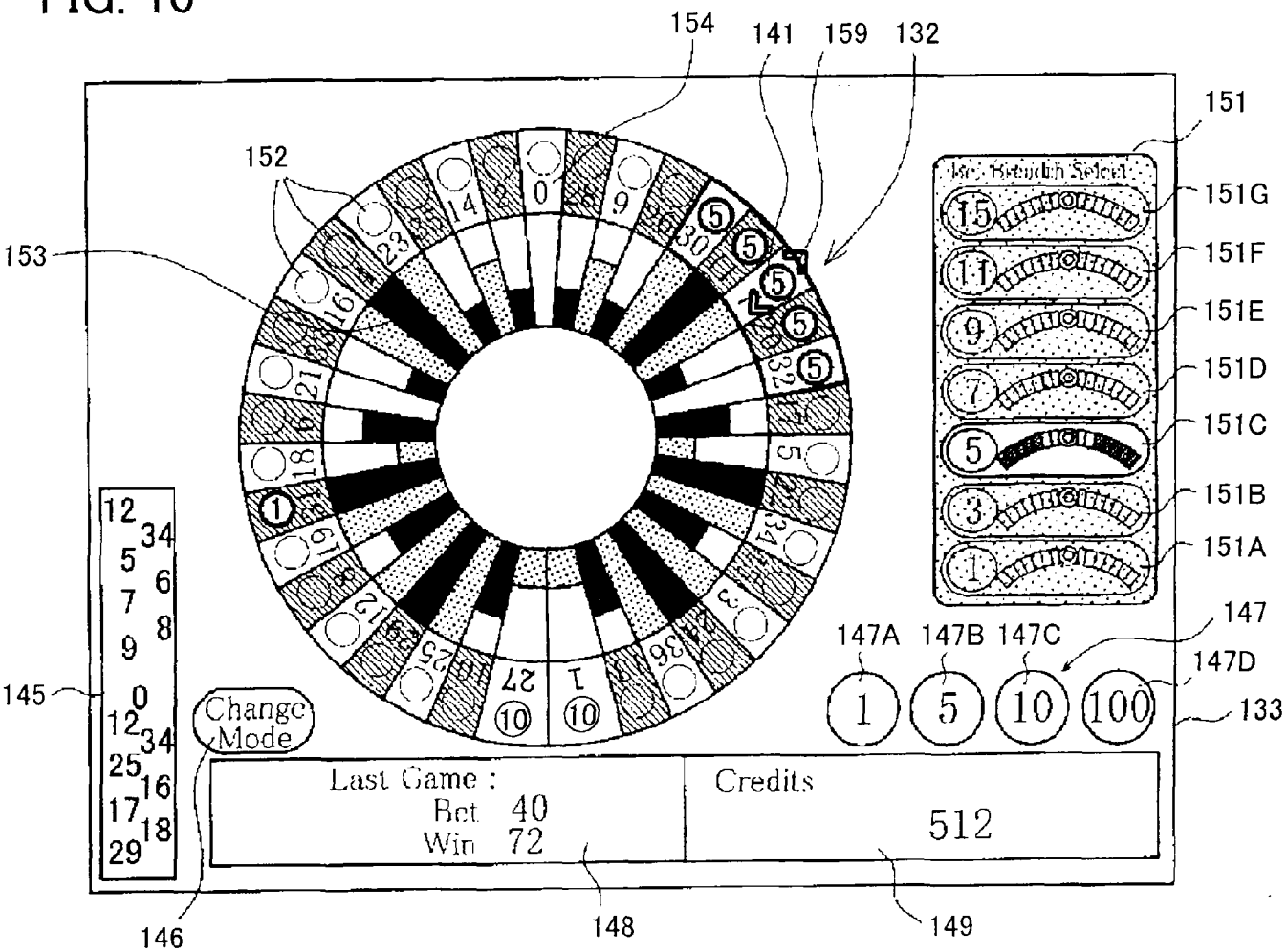
FIG. 10 is an illustrative diagram showing a bet screen of a wheel-type betting board.

On the other hand, the image display unit 7 is a so-called touch-panel type of liquid crystal display, on the front surface of which a touch panel 48 is attached, allowing a player to perform selections by pressing, e.g., with a finger, icons displayed on a liquid crystal screen. FIGS. 9 and 10 are views illustrating an exemplary display screen displayed on the image display unit during a game.

As shown in FIGS. 9 and 10, two types of screens, which are a first bet screen 131 having a table-type betting board 130 and a second bet screen 133 having a wheel-type betting board 132, are displayed on the image display device 7 during a game of the roulette game machine 1. Then, it is possible to switch the display between the first bet screen 131 and the second bet screen 133 each time screen switching buttons 134 and 146 displayed on the screen are pressed. Then, after selecting either the first bet screen 131 or the second bet screen 133, the player can bet a chip using the player's credits.

Firstly, the first bet screen 131 is described with reference to FIG. 9. The table-type betting board 130 displayed on the first bet screen 131 has numbers displayed in the marks 24 that match the numbers "0", "00", and "1" to "36", which are displayed in the form of a matrix. Furthermore, special bet areas, which allow the player to bet on "odd numbers", "even numbers", "the color of the marks (red or black)", "a predetermined range of the numbers (e.g., "1" to "12")", are provided in the form of a matrix in the same way.

Then, below the table-type betting board 130, a result history display unit 135, a screen switching button 134, the bet unit button 136, a payout result display unit 137, and a credit amount display unit 138 are displayed in this order, starting from the left of the screen.

The result history display unit 135 displays the results of the winning numbers of the past games up to and including the preceding game in the form of a list. The term "one game" as used here represents a series of stages from a stage in which the player places bets via each satellite 4, up to a stage in which a credit is paid out according to the winning number after the ball 11 has fallen in the pocket 23. With such an arrangement, upon completing one game, a new winning number is added to the top field of the list, which has the capacity to allow the players to confirm the history of the winning numbers for a maximum of 16 games.

Furthermore, as described above, the screen switching button 134 is a button that switches the display between the first bet screen 131 and the second bet screen 133 displayed on the image display device 7. Then, when the player presses the screen switching button 134 on the liquid crystal screen, it is possible to display the first bet screen 131 using the table-type betting board 130 and the second bet screen 133 using the wheel-type betting board 132 by switching therebetween. Then, the player bets a chip based on the betting board on the screen that is currently displayed.

The bet unit buttons 136 are buttons that allow the player to place bets using chips on the bet area 142 (squares having a number or mark, or lines which define the squares) designated by the player. The bet unit button unit is configured with four kinds of buttons including a 1-bet button 136A, a 5-bet button 136B, a 10-bet button 136C, and a 100-bet button 136D.

With such an arrangement, first, the player designates the desired bet area 142 on which bets are to be placed, with a cursor 140 (described later) by using a player's finger to directly push the screen. In this stage, upon the player pushing the 1-bet button 136A, chips are bet in increments of one chip (the amount of chips bet is incremented in the order of "1", "2", "3", . . . for each time the player pushes the 1-bet button 136A with the player's finger or the like). Upon the player pushing the 5-bet button 136B, chips are bet in increments of five chips (the amount of chips bet is incremented in the order of "5", "10", "15", . . . for each time the player pushes the 5-bet button 136B with the player's finger or the like). Upon the player pushing the 10-bet button 136C, chips are bet in increments of ten chips (the amount of chips bet is incremented in the order of "10", "20", "30", . . . for each time the player pushes the 10-bet button 136C with the player's finger or the like). Upon the player pushing the 100-bet button 136D, chips are bet in increments of one hundred chips (the amount of chips bet is incremented in the order of "100", "200", "300", . . . for each time the player pushes the 100-bet button 136D with the player's finger or the like). Such an arrangement simplifies the operation required for betting a large amount of chips.

In addition, the number of chips bet and payout credit amount for a player in a previous game are displayed in the payout result display unit 137. Here, a number obtained by subtracting the amount bet from the payout credits is the credits which the player has newly obtained by the previous game.

Furthermore, a credit amount display unit 138 displays the amount of credits which the player currently possesses. The credit amount decreases according to the number of chips bet (1 credit amount for 1 chip) when the player bets chips. Furthermore, in a case in which the player has won chips bet and credits are paid out, the credit amount is incremented by the credit amount thus paid out. It should be noted that the game is over in a case where the credit amount that the player possesses becomes zero.

Furthermore, a cursor 140 indicating the bet area 142, which the player has selected currently, is displayed on the table-type betting board 130. In addition, a chip mark indicating the bet area 142 and the number of chips bet up to this time is displayed. Here, the number displayed on the chip mark 141 represents the number of chips bet. For example, as shown in FIG. 9, a chip mark 141 of "7" disposed on the square "18" indicates that 7 chips have been bet to the number "18". In this way, a method for placing a bet on only one number is referred to as "straight up".

Furthermore, the chip mark of "1" disposed at the intersection of the lines that define the squares "5", "6", "8", and "9" indicates that one chip has been bet so as to cover the four numbers "5", "6", "8", and "9". It should be noted that a method for placing a bet so as to cover four numbers as described above is referred to as "corner bet".

Examples of the other betting methods include: a "split bet" for placing a bet so as to cover two numbers by locating the chip on the line between squares of two numbers; a "street bet" for placing a bet so as to cover three numbers (e.g., "13", "14", and "15") by locating the chip at the edge of the row of the numbers (each row along the vertical direction in FIG. 9); a "line bet" for placing a bet so as to cover six numbers (e.g., "13", "14", "15", "16", "17", and "18") by locating the chip at the end of the line between two rows of numbers (two rows along the vertical direction in FIG. 9); a "column bet" for placing a bet so as to cover twelve numbers by locating the chip at any one of the squares having the mark "2 to 1"; and a "dozen bet" for placing a bet so as to cover twelve numbers by locating the chip at any one of the squares having respective marks of "1st 12", "2nd 12", and "3rd 12". In addition, examples of other betting methods include: placing a bet on the color ("red" or "black") of the marks 24; placing a bet on whether the number is an odd number or an even number; and placing a bet on whether the number will be 18 or less, or will be 19 or more, so as to cover eighteen numbers, using one of six squares provided at the lower end of the table-type betting board 130.

When the player places a bet via the first bet screen 131 thus configured as described above, first, the player designates the desired bet area 142 (squares having a number and mark, and lines defining the squares), on which chips are to be bet, by directly pushing the bet area 142 on the screen. As a result, the cursor 140 is moved to the bet area 142 thus designated.

Subsequently, upon pushing any one of the bet unit buttons 136 (1-bet button 136A, 5-bet button 136B, 10-bet button 136C, and 100-bet button 136D), the amount of chips that correspond to the bet unit buttons are bet on the bet area 142 thus designated. For example, upon pushing the 10-bet button 136C four times, pushing the 5-bet button 136B once, and pushing the 1-bet button 136A three times, a total of 48 chips can be bet.

Next, the second bet screen 133 is described with reference to FIG. 10. On the wheel-type betting board 132 displayed on the second bet screen 133, the same numbers "0", and "1" to "36" disposed on the marks 24 are displayed in a wheel-type arrangement, which is the same as an actual roulette wheel 12.

Below the wheel-type betting board 132, similar to the first bet screen 131 as described above, the result history display unit 145, the screen switching button 146, the bet unit button 147, the payout result display unit 148, and the credit amount display unit 149 are displayed.

The result history display unit 145 displays the results of the winning numbers of the past games up to and including the preceding game in the form of a list. The term "one game" as used here represents a series of stages from a stage in which the players place bets via the satellites 4, up to a stage in which credits are paid out according to the winning number after the ball 11 has fallen into a pocket 23. With such an arrangement, upon completing one game, a new winning number is added to the top field of the list, which has the capacity to allow the players to confirm the history of the winning numbers for a maximum of 16 games.

Furthermore, as described above, the screen switching button 146 is a button that switches the display between the first bet screen 131 and the second bet screen 133 displayed on the image display device 7. Then, when the player presses the screen switching button 146 on the liquid crystal screen, it is possible to display the first bet screen 131 using the table-type betting board 130 and the second bet screen 133 using the wheel-type betting board 132 by switching therebetween. Then, the player bets a chip based on the betting board on the screen that is currently displayed.

The bet unit buttons 147 are buttons that allow the player to place bets using chips on the bet area 152 (on the number display portion 154 on which numbers are displayed) designated by the player. The bet unit button is configured with four kinds of buttons including a 1-bet button 147A, a 5-bet button 147B, a 10-bet button 147C, and a 100-bet button 147D. With such an arrangement, first, the player designates the desired bet area 152 on which bets are to be placed by using a player's finger to directly push the screen. Then, a cursor 159 (described later) is disposed in the bet area 152 thus designated. It should be noted that, in the wheel-type betting board 132 of the second bet screen 133, each bet area 152 in which a chip is bet is provided to each number thus displayed. In this stage, upon the player pushing the 1-bet button 147A, chips are bet in increments of one chip (the amount of chips bet is incremented in the order of "1", "2", "3", . . . for each time the player pushes the 1-bet button 147A with the player's finger or the like). Upon the player pushing the 5-bet button 147B, chips are bet in increments of five chips (the amount of chips bet is incremented in the order of "5", "10", "15", . . . for each time the player pushes the 5 bet button 147B with the player's finger or the like). Upon the player pushing the 10-bet button 147C, the chips are bet in increments of ten chips (the amount of chips bet is incremented in the order of "10", "20", "30", . . . for each time the player pushes the 10-bet button 147C with the player's finger or the like). Upon the player pushing the 100-bet button 147D, the chips are bet in increments of one hundred chips (the amount of chips bet is incremented in the order of "100", "200", "300", . . . for each time the player pushes the 100-bet button 147D with the player's finger or the like). Such an arrangement simplifies the operation required for betting a large amount of chips.

In addition, the number of chips bet and the payout credit amount for a player in a previous game are displayed in the payout result display unit 148. Here, a number obtained by subtracting the amount bet from the payout credits is the credits which the player has newly obtained by the previous game.

Furthermore, a credit amount display unit 149 displays the amount of credits which the player currently possesses. The credit amount decreases according to the number of chips bet (1 credit amount for 1 chip) when the player bets chips. Furthermore, in a case in which the number of the bet area 152 that the player placed a bet has won and credits are paid out, the credit amount is incremented by the credit amount thus paid out. It should be noted that the game is over in a case where the credit amount that the player possesses becomes zero.

Figure 11:
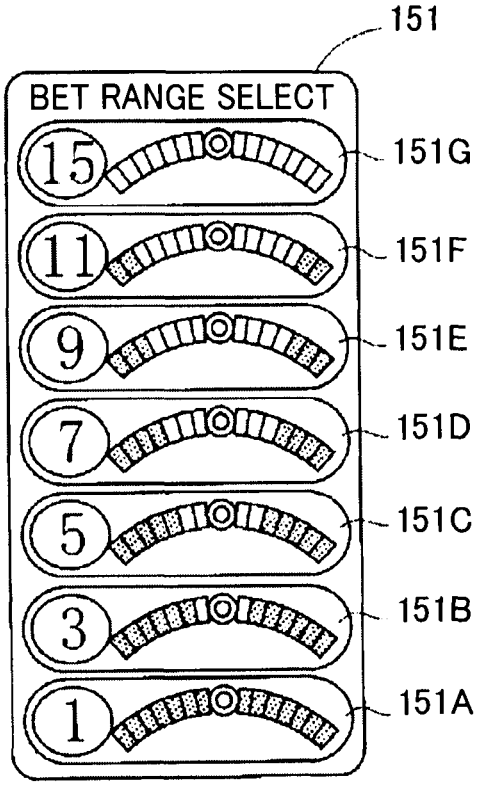
FIG. 11 is a diagram showing an example of a bet operation using the wheel-type betting board.

A bet range setting unit 151 is provided at the right side on the wheel-type betting board 132 of the second bet screen. The bet range setting unit 151 is a unique function of the wheel-type betting board 132 and it is possible to place a bet not only on the bet area 152 thus designated, but also on the periphery thereof simultaneously by setting the bet range at the bet range setting unit 151. The bet range setting unit 151 is configured with seven types of buttons which includes: a 1 range setting button 151A; a 3 range setting button 151B, a 5 range setting button 151C, a 7 range setting button 151D, a 9 range setting button 151E, a 11 range setting button 151 F, a 15 range setting button 151G, and thus a bet range can be set to "1", "3", "5", "7", "9", "11", and "15", respectively. Here, a bet range represents the number of total bet areas including the bet area 152 to be selected (described later) and the bet area 152 that is disposed at both sides thereof and can be bet simultaneously. FIG. 11 is an enlarged view of the bet range setting unit 151 according to the present embodiment.

As shown in FIG. 11, the 1 range setting button 151A is set so that a bet is placed only on a designated bet area 152. Furthermore, the 3 range setting button 151B is set so that bets are placed on three bet areas 152 in total simultaneously, including a designated bet area 152 and bet areas 152 having numbers disposed at either side thereof. Furthermore, the 5 range setting button 151C is set so that bets are placed on five bet areas 152 in total simultaneously, including a designated bet area 152 and two bet areas 152 having numbers disposed at either side thereof. Furthermore, the 7 range setting button 151D is set so that bets are placed on seven bet areas 152 in total simultaneously, including a designated bet area 152 and three bet areas 152 having numbers disposed at either side thereof. Furthermore, the 9 range setting button 151E is set so that bets are placed on nine bet areas 152 in total simultaneously, including a designated bet area 152 and four bet areas 152 having numbers disposed at either side thereof. Furthermore, the 11 range setting button 151F is set so that bets are placed on eleven bet areas 152 in total simultaneously, including a designated bet area 152 and five bet areas 152 having numbers disposed at either side thereof. Furthermore, the 15 range setting button 151G is set so that bets are placed on fifteen bet areas 152 in total simultaneously, including a designated bet area 152 and seven bet areas 152 having numbers disposed at either side thereof.

Then, the player selects each bet range by pressing a button of a bet range that the player desires, and can perform betting of a chip based on the bet range thus selected (any one of "1", "3", "5", "7", "9", "11", and "15").

A betting method in the wheel-type betting board 132 includes only a method for placing a bet on a single bet area 152 (a number) to be designated ("straight up" in the table-type betting board 130). However, by setting a bet range in the abovementioned bet range setting unit 151, a chip can be placed on the bet area 152 (a number) thus designated as well as the same number of bet areas 152 (numbers) disposed in a symmetric position at either side of the bet area 152 thus designated, according to the bet range thus set. For example, in a case in which the bet range "5" is set by the 5 range setting button 151C and the square of the number "7" is designated as a bet area 152, it is possible to place a bet on the five bet areas 152 around the square of the number "7" simultaneously (the numbers "30", "11", "17", "20", and "32").

Figure 12:
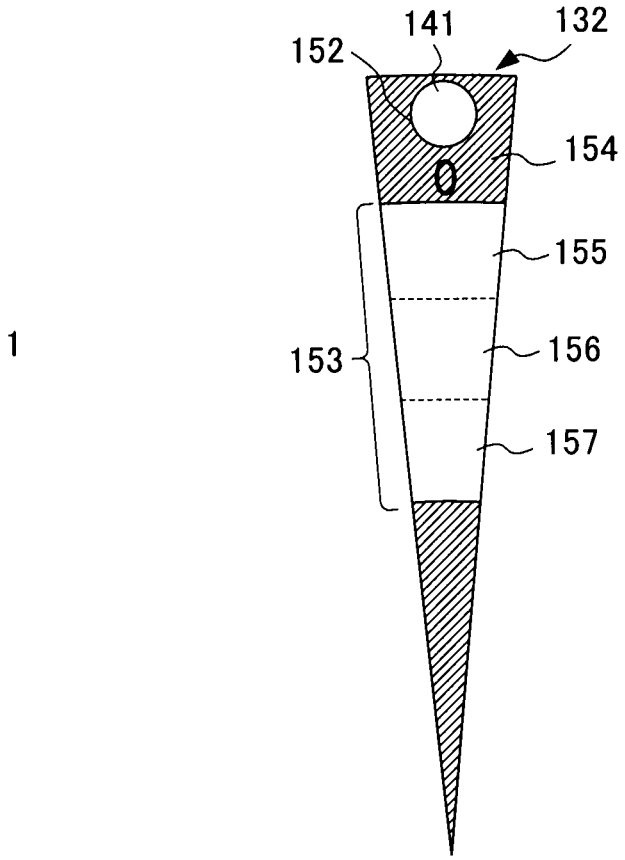
FIG. 12 is a diagram showing a historical graph displayed on a bet screen of the wheel-type betting board.

Furthermore, inside of the circle of the number display portion 154 in which each number is depicted in the wheel-type betting board 132 of the second bet screen, a history graph 153 corresponding to each bet area is provided in a wheel-type arrangement. The history graph 153 is shown in a bar graph so that each of the histories of bet areas 152 (a number) which have won up to the previous game can be visually recognized easily. FIG. 12 is an enlarged schematic diagram of a portion of the wheel-type betting board.

As shown in FIG. 12, the history graph 153 is disposed inside the number display portion 154 in which a number is displayed, and is configured with three areas: a first graph area 155; a second graph area 156; and a third graph area 157.

Then, each of these areas is configured to be displayed by way of lighting based on a history (a winning rate) of a winning number.

More specifically, based on the game results down to the previous 100 games, in a case in which there exists only one winning result, the first graph area that corresponds to the winning number (the bet area 152 that was won) lights up. Then, in a case in which there exist at least three winning results, the second graph area that corresponds to the winning numbers lights up. Furthermore, in a case in which there exist at least five winning results, the third graph area that corresponds to the winning numbers lights up. Therefore, when the player tries to know the previous game results, it is possible to easily visually determine which position in the roulette wheel 4 and in what frequency the ball 11 falls. Here, as described above, on the wheel-type betting board 132 displayed on the second bet screen 133, since the numbers are displayed in a wheel-type arrangement, which is the same as an actual roulette wheel 4, the effect is further improved.

In addition, other than displaying by way of lighting each of the graph areas 155 to 157, each of the graph areas 155 to 157 may be distinguished from the circumference thereof by changing a color pattern of each of the graph areas 155 to 157.

Furthermore, as described above, since it is possible to place a bet not only on the bet area 152 thus designated but also on the periphery thereof simultaneously by setting the bet range at the bet range setting unit 151 in the wheel-type betting board 132, it is possible for the player to predict a point where the ball 11 will fall and place a bet on neighboring numbers of the point based on the history graph 153. Accordingly, it is possible to enjoy various types of play, which can also enhance the motivation of the player to play a game. In addition, by pressing the screen switching button 146, since it is possible to display the first bet screen 131 utilizing the table-type betting board 130 for betting, betting with consideration of various demands from players is possible.

Furthermore, a cursor 159 indicating the bet area 152, which the player has currently selected, is displayed on the table-type betting board 132. In addition, a chip mark 141 indicating the bet area 152 and the number of chips bet up to this time are displayed. Here, the number displayed on the chip mark 141 represents the number of chips bet. For example, as shown in FIG. 10, a chip mark 141 showing "1" disposed on the square "31" indicates that 1 chip has been bet on the number "31".

When the player places a bet via the second bet screen 133 thus configured as described above, first, the player designates the desired bet area 152 (the number displayed on the number display portion 154), on which chips are to be bet, by directly pushing the bet area 152 on the screen. As a result of this, the cursor 159 is moved to the bet area 152 thus designated. Afterward, the player designates a desired bet range at the bet range setting unit 151 by pressing any one of a 1 range setting button 151A, a 3 range setting button 151B, a 5 range setting button 151C, a 7 range setting button 151D, a 9 range setting button 151E, an 11 range setting button 151F, and a 15 range setting button 151G. Subsequently, upon pushing any one of the bet unit buttons 147 (1-bet button 136A, 5-bet button 136B, 10-bet button 136C, and 100-bet button 136D), the amount of chips that correspond to the bet unit buttons are bet on the bet area 152 thus designated (the amount of chips is bet on the plurality of bet areas 152 if a bet range other than the "1" bet range is designated). For example, upon pushing the "10" unit bet button 147 four times, pushing the "5" bet button once, and pushing the "1" bet button three times, a total of 48 chips can be bet.

Figure 13:
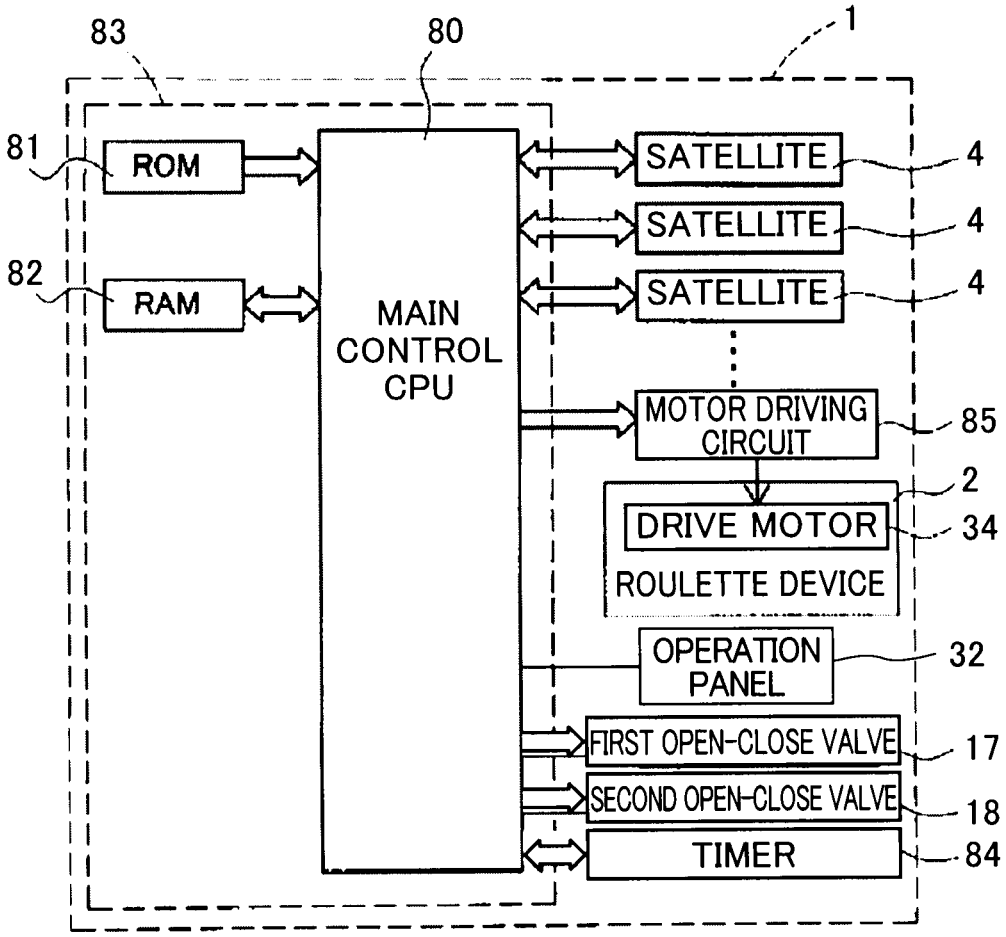
FIG. 13 is a block diagram showing a control system of a roulette device.

Next, a configuration related to a control system for the roulette game device 1 is described with reference to FIG. 13. FIG. 13 is a block diagram showing a control system of the roulette game device schematically. As shown in FIG. 13, the roulette game device 1 is configured with a main control unit 83 including a main control CPU 80, ROM 81, and RAM 82, a roulette device 2 connected with the main control unit 83, 10 satellites 4 (see FIG. 1), a first open-close valve 17 and a second open-close valve 18, and an operation panel 32.

The main control CPU 80 carries out a various processing based on input signals supplied from the respective satellites 4 as well as on data and programs stored in the ROM 81 and the RAM 83, and transmits a command signal to the satellite 4 based on the result of the above described processing so as to mainly control the respective satellites 4 in the order that the game proceeds. Furthermore, based on detection signals from an origin position sensor 510, pocket position sensors 520*a* and 520*b*, a transmission sensor 530, a reflective sensor 540, a transmission sensor 550, and a reflective sensor 560, the determination of a winning number among the pockets 23 in which the ball 11 falls is performed. The determination is performed for each bet chip based on the winning number thus obtained, and the bet information transmitted from each of the satellites 4. Furthermore, the credit amount which is to be paid out at each of the satellites 4 is calculated.

The ROM 81 is, for example, configured with semiconductor memory and the like, and stores a program for realizing basic functions of the roulette game device 1, a program for controlling respective devices in the roulette device, the first open-close valve 17, and the second open-close valve 18, odds for a normal roulette game using the bet screen 51 (the amount of credits paid out per one chip for winning), a program for mainly controlling each of the satellites 4, and the like.

On the other hand, the RAM 82 temporarily stores bet information with respect to the chips supplied from the respective satellites 4, a winning number of the roulette device 2, and data relating to the results of the processing executed by the main control CPU 80, etc.

Furthermore, the first open-close valve 17 and the second open-close valve 18 that perform adjustment of air pressure within air tubes 15 and 16 are connected to the main control CPU 80. Then, by opening the first open-close valve 17, air that has been compressed by way of the compressor 14 (see FIG. 2) is discharged from the first discharge opening 35 that is disposed at the pockets 23. In addition, by opening the second open-close valve 18, air that has been compressed by way of the compressor 14 is discharged from the second discharge opening 36 that is disposed at the bank path 29.

Then, the first open-close valve 17 is opened for a predetermined time (for example, 2 seconds), for example, a predetermined time after bet acceptance has begun. As a result, the ball 11, which had been held in the pocket 23 since the end of the previous game, is caused to roll in a direction toward the bank path 29 by way of air pressure.

Subsequently, the second open-close valve 18 is opened and a layer of air flowing is generated along the bank path 29 of the roulette wheel 12. Then, the ball 11 that has rolled into the bank path 29 by way of air pressure from the first discharge opening 35 rolls in a clockwise direction according to the layer of the air flowing circularly along the bank path 29.

Afterward, upon a predetermined lapse of time, when the second open-close valve 18 is closed, the air flow discharged from the second discharge opening 36 also comes to stops, and the revolution speed of the ball 11 gradually slows down. Then, a bet is ended immediately before the ball loses its centrifugal force and falls and rolls down the inclined face 28, and then, the ball falls in any one of the pockets 23.

Bet end timing is set through an external operation of the operation panel 32 by staff in a game hall. For example, the setting such as ending a bet when the remaining number of revolutions is one, and furthermore, switching BGM five revolutions before it is performed so as to notify players that the bet end timing is near.

Then, the main control CPU 80 performs determination of the winning number based on the origin sensor 510, the pocket position sensors 520*a* and 520*b*, the transmission sensor 530, the reflective sensor 540, the transmission sensor 550, and the reflective sensor 560.

In addition, a drive motor 34 that drives the wheel 22 of the roulette wheel 12 to revolve is connected to the main control CPU 80 via a motor driving circuit 85. Then, over a period from immediately after the ball 11 begins to roll until a predetermined time period elapses after the ball 11 has fallen into a pocket 23, the drive motor 34 is controlled so that the wheel 22 is caused to rotate in a predetermined direction with respect to the frame body 21 (for example, in a clockwise direction) and at a predetermined speed.

Furthermore, the timer 84 for performing time measurement is connected to the main control CPU 80. Time information of the timer 84 is transmitted to the main control CPU 80, and the main control CPU 80 performs opening and closing of the first open-close valve 17 and the second open-close valve 18 based on the time information of the timer 84 as described later.

Figure 14:
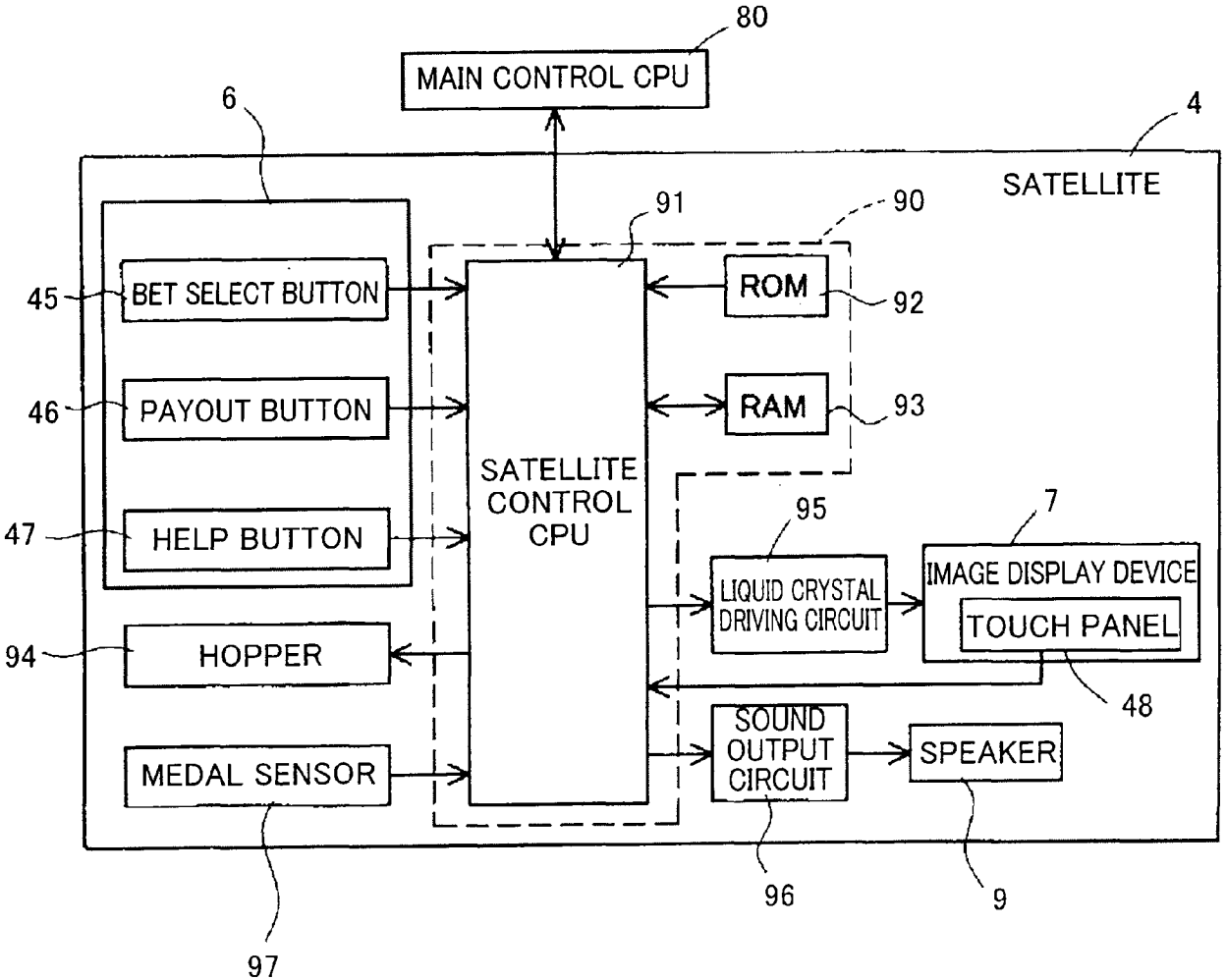
FIG. 14 is a block diagram showing a control system of a satellite.

Next, a configuration according to a control system of the satellite 4 connected to the main control CPU 80 in the main control unit 83 is described with reference to FIG. 14. FIG. 14 is a block diagram schematically showing a control system of a satellite. It should be noted that the configuration in which ten satellites 4 are provided has the same configuration as that in which one satellite 4 is provided. Therefore, the configuration in which one satellite 4 is provided is described as an example below.

As shown in FIG. 14, the satellite 4 is configured with a satellite control unit 90 and several peripheral devices. The satellite control unit 90 includes a satellite control CPU 91, ROM 92, and RAM 93. The ROM 92, which is configured with semiconductor memory or the like, for example, stores a program for implementing basic functions of the satellite 4, other various programs needed to control the satellite 4, a data table, and the like. The RAM 93 is memory for temporarily storing various types of data computed by the satellite control CPU 91, an amount of credits that a player currently possesses, a bet status of chips by the player, and the like.

Furthermore, a bet select button 45, a payout button 46, and a help button 47 provided in the control unit 6 (see FIG. 1) are connected to the satellite control CPU 91, respectively. Then, the satellite control CPU 91 controls the execution of various corresponding operations based on manipulation signals, which are outputted in response to each button pressed by a player. More specifically, the satellite control CPU 91 executes various types of processing, based on input signals supplied from the control unit 6 in response to a player's manipulation which has been inputted, and the data and programs stored in the ROM 92 and the RAM 93. Subsequently, the satellite control CPU 91 transmits the results to the main control CPU 80 in the main control unit 83.

On the other hand, the satellite control CPU 91 receives a command signal from the main control CPU 80, controls the peripheral devices, which are components of the satellite 4, and advances a roulette game at the satellite 4. In addition, the satellite control CPU 91 carries out various processing, depending on the contents of the processing, based on an input signal supplied from the control unit 6 in response to the operational input of a player as well as based on data and programs stored in the ROM 92 and the RAM 93, controls the peripheral devices, which are components of the satellite 4 based on the results of the above described processing, and advances a roulette game at the satellite 4. It should be noted that the mode whereby processing is performed is set for each type of processing depending on the content of the processing. For example, processing for payout of medals according to a winning number falls into the former and processing for a bet operation on the bet screen 131 by a player falls into the latter.

In addition, a hopper 94 is connected to the satellite control CPU 91. The hopper 94 pays out a predetermined number of medals from a medal payout opening 8 (see FIG. 1) in response to an instructional signal from the satellite control CPU 91.

Moreover, an image display device 7 is connected to the satellite control CPU 91 via a liquid crystal driving circuit 95. The liquid crystal driving circuit 95 includes program ROM, image ROM, an image control CPU, work RAM, a video display processor (VDP), video RAM, and the like. Here, the program ROM stores an image control program related to the display functions of the image display device 7, and various kinds of selection tables. Furthermore, the image ROM stores dot data for creating an image to be displayed on the image display device 7, for example. In addition, the image control CPU determines an image to be displayed on the image display device 7, selected from the dot data previously stored in the image ROM according to the image control program previously stored in the program ROM based on parameters set by the satellite control CPU 91. The work RAM is configured as a temporary storage means when executing the image control program by the image control CPU. The VDP forms an image corresponding to the display contents determined by the image control CPU and outputs the resulting image on the image display device 7. It should be noted that the video RAM is configured as a temporary storage means when forming an image by the VDP.

As mentioned above, the touch panel 48 is attached to the front side of the image display device 7, and the information related to an operation on the touch panel 48 is transmitted to the satellite control CPU 91. On the touch panel 48, a bet operation for placing a chip by a player is performed. More specifically, a selection of a bet area, an operation of the unit bet button 136, and the like are performed by operating the touch panel 48, and the information related thereto is transmitted to the satellite control CPU 91. Then, the RAM 93 stores the current player bet information (the bet area designated on the bet screen 131, and the amount of chips bet at the current point in time) as necessary. Furthermore, the bet information is transmitted to the main control CPU 80 and stored in a bet information storage area in the RAM 82.

A sound output circuit 96 and a speaker 80 are further connected to the satellite control CPU 91. The speaker 9 produces various sound effects for implementing various effects based on output signals from the sound output circuit 96.

In addition, a medal sensor 97 is connected to the satellite control CPU 91. The medal sensor 97 detects the medals inserted into the medal insertion opening 5 (FIG. 1), counts the medals thus inserted, and transmits the results to the satellite control CPU 91. Then, the satellite control CPU 91 increments the credit amount which has been deposited by the player and which is stored in the RAM 93, according to the signal thus transmitted.

Main processing of the roulette device 2 is described with reference to FIG. 15.

In Step S10, the main control CPU 80 performs initial setting processing such as RAM access permission, backup return processing, and initialization of working area. When this processing is terminated, the main control CPU 80 advances the processing to Step S20.

In Step S20, the main control CPU 80 performs game start processing. This processing is further described below. When this processing is terminated, the main control CPU 80 advances the processing to Step S30.

In Step S30, the main control CPU 80 performs input monitoring processing. In this processing, the main control CPU 80 performs monitoring of detection signals from the origin sensor 510, the pocket position sensors 520*a* and 520*b*, the transmission sensors 530 and 550, the reflective sensors 540 and 560, and ball revolution sensors 570 and 580. A detailed description is provided later regarding this processing. When the processing is terminated, the main control CPU 80 advances the processing to Step S40.

In Step S40, the main control CPU 80 performs drive motor control processing. In this processing, the main control CPU 80 performs rotation control of the drive motor so as to change the rotation speed of the wheel 22 randomly in each game. More specifically, the main control CPU 80 performs rotation control of the wheel 22 based on the rotation speed determined in the processing of Step S120, which is described later using FIG. 16. In a case in which this processing is terminated, the main control CPU 80 advances the processing to Step S50.

In Step S50, the main control CPU 80 performs compressor control processing. In this processing, the main control CPU 80 performs drive control of the compressor 14 so as to change the time period of lateral air blowing toward the ball 11 randomly in each game. More specifically, the main control CPU 80 performs drive control of the compressor 14 based on the time period of lateral air blowing of the air determined in the processing of Step S130, which is described using FIG. 16. When this processing is terminated, the main control CPU 80 advances the processing to Step S60.

In Step S60, the main control CPU 80 performs BGM control processing. This processing is further described below. When this processing is terminated, the main control CPU 80 advances the processing to Step S70.

In Step S70, the main control CPU 80 performs lamp control processing that performs lighting control of various types of lamps. When this processing is terminated, the main control CPU 80 advances the processing to Step S80.

In Step S80, the main control CPU 80 performs game result determination processing. In this processing, the main control CPU 80 determines a pocket in which the ball 11 has fallen based on the origin sensor 510, the pocket position sensors 520*a* and 520*b*, the transmission sensors 530 and 550, and the reflective sensors 540 and 560. More specifically, during rotation of the wheel 22 after the ball 11 has fallen into a pocket, when either one of the reflective sensors 540 and 560 detects the ball 11, by specifying a rotating position of the wheel from the origin point at that point in time based on the detection signals of the origin sensor 510 and the pocket position sensors 520*a* and 520*b*, a type of the pocket located at the reflective sensors 540 and 560 that detected the ball 11 is specified. In this way, it is possible to specify the type of pocket in which the ball 11 falls. Then, the main control CPU 80 compares the bet information received from the satellite 4 with the game result and determines the number of medals thus paid out in each satellite 4. Then, by setting in the RAM 82 the game result, namely, data of a mark 24 that corresponds to the pocket in which the ball 11 fell and the number of medals thus paid out, by the processing of Step S90, mark data that corresponds to a pocket and the like is transmitted to the satellite. When this processing is terminated, the main control CPU 80 advances the processing to Step S90.

In Step S90, the main control CPU 80 performs processing to transmit and receive various types of data with the satellite 4. More specifically, game start data, remaining revolution data, game result data, data of the number of medals paid out, and the like are transmitted from the main control CPU 80 to the satellite 4, and data related to bet information is transmitted from the satellite 4 to the main control CPU 80. When this processing is terminated, the main control CPU 80 advances the processing to Step S100.

In Step S100, game end processing is performed. In this processing, after transmitting the game result to the satellite 4, the main control CPU 80 performs processing to return various types of variables and flags into an initial state such as turning off a flag of remaining revolutions and a BGM flag. When this processing is terminated, the main control CPU 80 advances the processing to Step S20.

Figure 15:
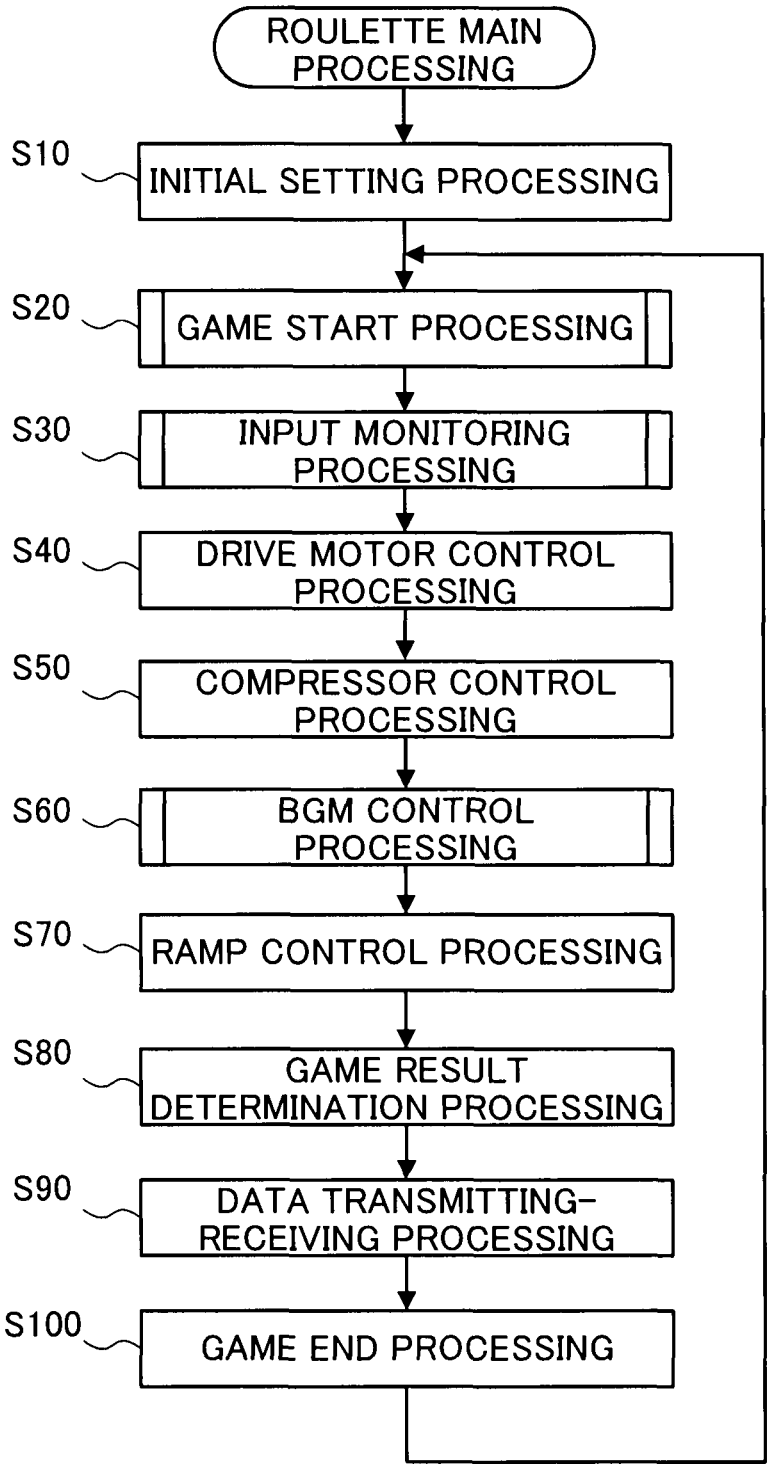
FIG. 15 is a flowchart showing control processing executed in a roulette game device according to the present embodiment.
Figure 16:
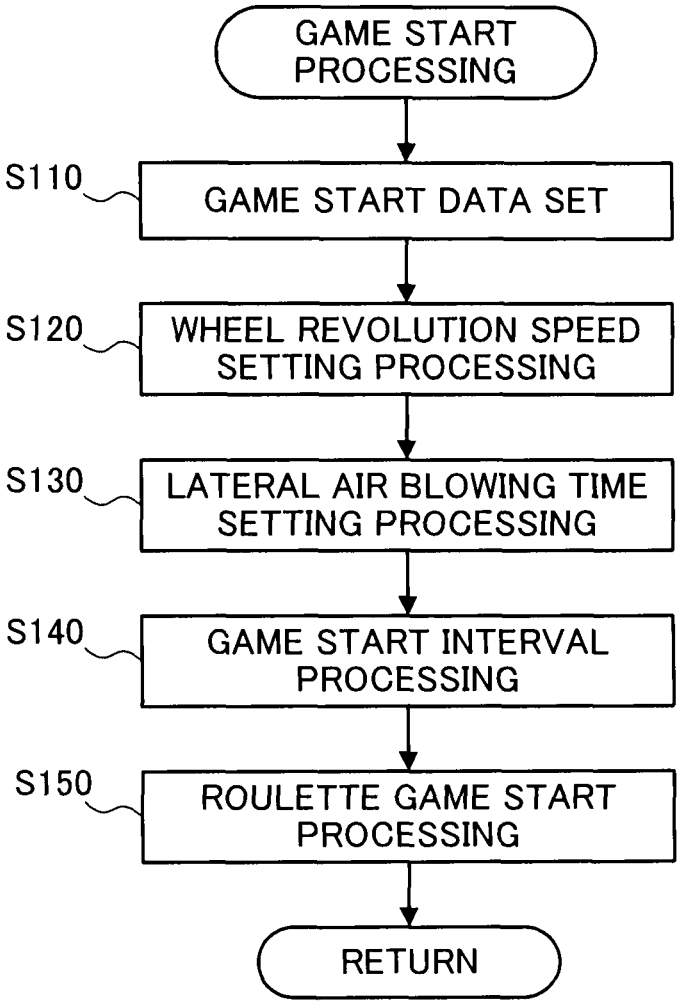
FIG. 16 is a flowchart showing control processing executed in a roulette game device according to the present embodiment.

Game start processing shown in FIG. 15 is described with reference to FIG. 16.

In Step S110, the main control CPU 80 performs processing to set instructional data to start a game to the RAM 82. The game start data thus set is transmitted to each of the satellites 4 by the processing of Step S90 of FIG. 15. When this processing is terminated, the main control CPU 80 advances the processing to Step S120.

In Step S120, the main control CPU 80 performs processing to set the rotation speed of the wheel 22. More specifically, using a wheel 22 speed table shown in FIG. 23, one rotation speed is determined randomly by way of a lottery of random numbers among 37-step rotation speeds in the range of 6 rpm to 11 rpm. Therefore, it becomes highly possible that the rotation speed of the wheel 22 changes in each game. When this processing is terminated, the main control CPU 80 advances the processing to Step S130.

In Step S130, processing to set lateral air blowing is performed. This main control CPU 80 determines a time period of lateral air blowing randomly, more specifically, in the range from 2.0 to 2.5 seconds, and sets it to the RAM 82. Then, the main control CPU 80 controls driving of the drive motor 34 by the processing of Step S40 of the FIG. 15 based on the data of the time period of lateral air blowing thus determined, and transmits it to the satellite 4 by the processing of Step S90 of the FIG. 90. When the processing is terminated, the main control CPU 80 advances the processing to Step S140.

In Step S140, game start interval processing is performed. In this processing, the main control CPU 80 performs processing to control an interval from a time at which a game starts to a time at which the roulette wheel actually starts to rotate. When this processing is terminated, the main control CPU 80 advances the processing to Step S150.

In Step S150, roulette game start processing is performed. In this processing, the main control CPU 80 performs processing to start a roulette game after a predetermined interval has elapsed in Step S140. More specifically, the main control CPU 80 performs processing to instruct launching of the ball 11 and starting rotation of the wheel 22. When this processing is terminated, the satellite control CPU 91 ends the present sub routine.

Figure 17:
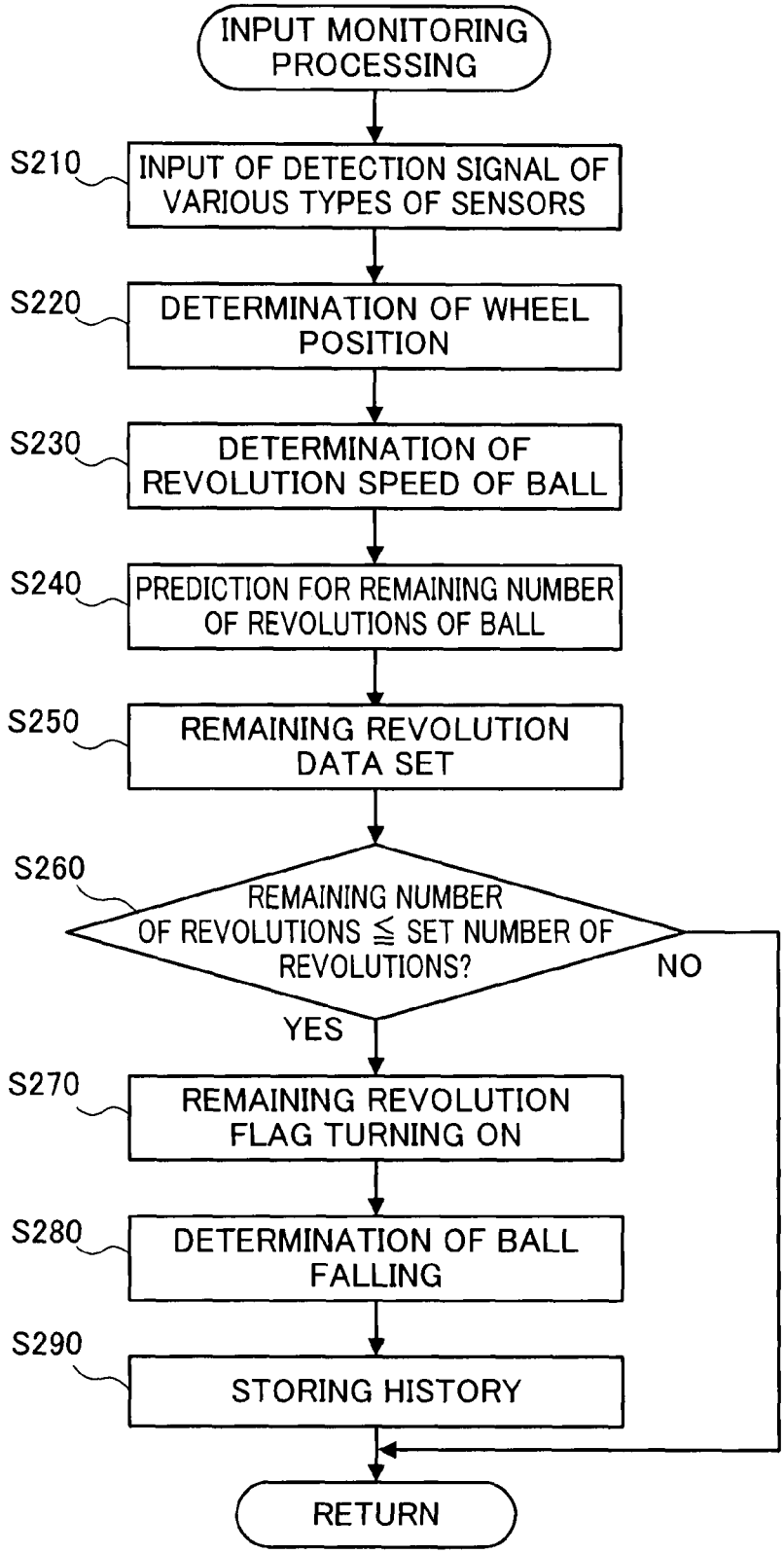
FIG. 17 is a flowchart showing control processing executed in a roulette game device according to the present embodiment.

Input monitoring processing shown in FIG. 15 is described with reference to FIG. 17.

In Step S210, the main control CPU 80 performs processing to input detection signals from the origin sensor 510, the pocket position sensors 520*a* and 520*b*, the transmission sensors 530 and 550, the reflective sensors 540 and 560, and the ball revolution sensors 570 and 580. When this processing is terminated, the main control CPU 80 advances the processing to Step S220.

In Step S220, the main control CPU 80 performs processing to determine a rotating position of the wheel 22. More specifically, the main control CPU 80 can specify a rotating position of the wheel 22 based on a number of convex and concave portions to be detected by the pocket position sensors 502*a* and 502*b* after the origin position sensor detects the origin position. When this processing is terminated, the main control CPU 80 advances the processing to Step S230.

In Step S230, the main control CPU 80 measures the time during which the ball revolution sensor 570 detects the ball 11 and then the ball revolution sensor 580 detects the same. Here, since the revolving distance from the ball revolution sensor 570 to the ball revolution sensor 580 is constant, it is possible to calculate a revolution speed from the ball revolution sensor 570 to the ball revolution sensor 580. Then, the main control CPU 80 measures a revolution speed each time the ball revolution sensor 570 and the ball revolution sensor 580 detect the ball 11, and stores it as speed data to the RAM 82. When the processing is terminated, the main control CPU 80 advances the processing to Step S240.

In Step S240, the main control CPU 80 performs processing to predict a remaining number of revolutions until the ball 11 falls to a side of the wheel 22 based on the speed data stored in the RAM 82. When the processing is terminated, the main control CPU 80 advances the processing to Step S250.

In Step S250, the main control CPU 80 performs processing to set the remaining revolution data to the RAM 82. This remaining revolution data is transmitted to the satellite 4 by the processing of Step S90 of FIG. 15. When the processing is terminated, the main control CPU 80 advances the processing to Step S260.

In Step S260, the main control CPU 80 performs processing to determine whether a number of the remaining revolutions has become less than the remaining number of revolutions which is set as bet end timing. In this processing, the main control CPU 80 compares the remaining number of revolutions predicted in Step S240 with, for example, the set number of revolutions set by operation of the operation panel 32 by the staff in a game hall and, in a case in which it is determined that the remaining number of revolutions is less than the set number of revolutions, advances the processing to Step S270. In a case in which it is not determined that the remaining number of revolutions is less than the set number of revolutions, the main control CPU 80 ends the present sub routine.

In Step S270, the main control CPU 80 performs processing to set in the RAM 82 a value at which a remaining revolution flag is turned on. In addition, the data of the remaining revolution flag is transmitted to the satellite 4 as bet end timing data by the processing of Step S90 of FIG. 15. When the processing is terminated, the main control CPU 80 advances the processing to Step S280.

In Step S280, the main control CPU 80 performs processing to determine whether it is a timing at which the ball 11 falls. More specifically, the main control CPU 80 performs processing to determine whether an amount of received light that a light receiving element of the ball revolution sensor 580 detects is larger than a predetermined threshold and, in a case in which it is determined to be smaller than the predetermined threshold, performs processing to determine the ball 11 has fallen. When this processing is terminated, the main control CPU 80 advances the processing to Step S290.

In Step S290, the main control CPU 80 performs processing to cumulatively store in the RAM 82, each time a game is executed, history data that includes a time period from when the ball 11 is launched until a timing at which the ball 11 falls is determined. Then, in a case in which a predetermined number of games (for example, 64 times) is performed, a predicted value for the remaining number of revolutions is adjusted depending on an amount of change of the timing of the ball falling. When this processing is terminated, the satellite control CPU 91 ends the present sub routine.

Figure 18:
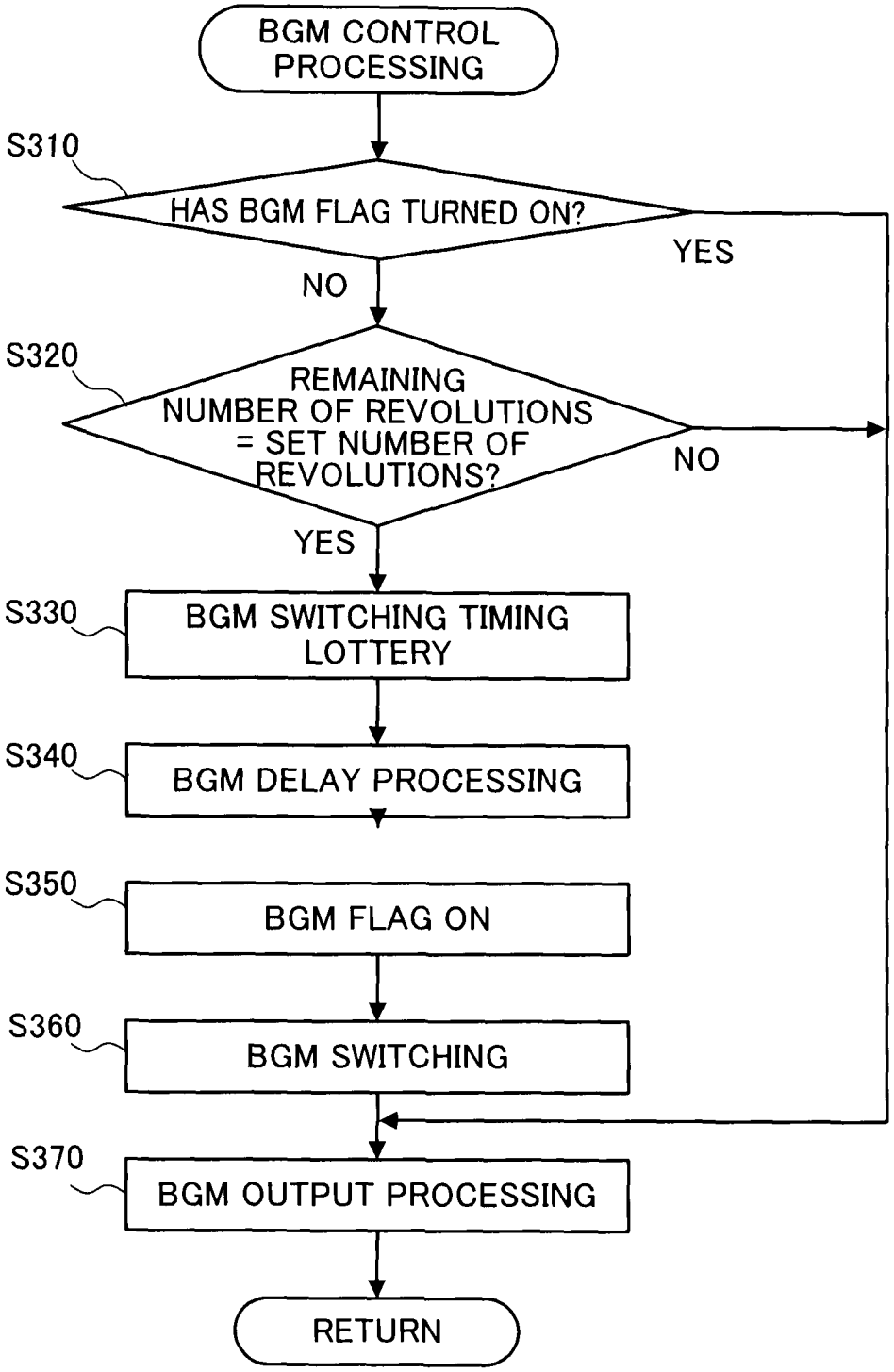
FIG. 18 is a flowchart showing control processing executed in a roulette game device according to the present embodiment.

BGM control processing shown in FIG. 15 is described with reference to FIG. 18.

In Step S310, the main control CPU 80 determines whether a BGM flag set in a predetermined area in the RAM 82 is turned on and, in a case in which it is determined that the BGM flag is in an on state, advances the processing to Step S370. In a case in which it is not determined that the BGM flag is in an on state, the main control CPU 80 advances the processing to Step S320.

In Step S320, as a timing of notifying that bet end timing is soon by switching the BGM, the main control CPU 80 performs processing to determine whether the remaining number of revolutions is equal to the set number of revolutions set by the operation of the operation panel 32 (for example, 5 revolutions before the bet end timing). In this processing, in a case in which it is determined that the remaining number of revolutions is equal to the set number of revolutions, the main control CPU 80 advances the processing to Step S330. In a case in which it is not determined that the remaining number of revolutions is equal to the set number of revolutions, the main control CPU 80 advances the processing to Step S370.

In Step S330, the main control CPU 80 performs processing to determine a timing of switching the BGM by lottery. More specifically, the main control CPU 80 sets switching the BGM with a delayed timing in a range from 0 seconds to 2 seconds. When the processing is terminated, the main control CPU 80 advances the processing to Step S340.

In Step S340, the main control CPU 80 performs processing to delay the timing of switching the BGM by the timing set in the Step S330. When the processing is terminated, the main control CPU 80 advances the processing to Step S350.

In Step S350, the main control CPU 80 performs processing to set in the RAM 82 a value at which the BGM flag turns on. In a case in which the processing is terminated, the main control CPU 80 advances the processing to Step S360.

In Step S360, the main control CPU 80 performs processing to set in the RAM 82 a value at which the BGM flag turns on. In a case in which the processing is terminated, the main control CPU 80 advances the processing to Step S370.

In Step S370, the main control CPU 80 performs processing to output the BGM thus set. When this processing is terminated, the satellite control CPU 91 ends the present sub routine.

A main processing of the satellite 4 is described with reference to FIG. 19.

In Step S400, the satellite control CPU 91 performs processing to determine whether credits remain or not. In a case in which it is determined that credits remain, the satellite control CPU 91 performs initial setting processing such as RAM access permission, backup return processing, and initialization of working area. When the processing is terminated, the satellite control CPU 91 advances the processing to Step S410.

In Step S410, the satellite control CPU 91 performs transmitting and receiving of data with the roulette device 2. When this processing is terminated, the satellite control CPU 91 advances the processing to Step S420.

In Step S420, the satellite control CPU 91 performs received data analysis processing. This processing is further described below. When this processing is terminated, the satellite control CPU 91 advances the processing to Step S430.

In Step S430, the satellite control CPU 91 performs bet processing. This processing is further described below. When the processing is terminated, the satellite control CPU 91 advances the processing to Step S440.

In Step S440, the satellite control CPU 91 performs display control processing. In this processing, the satellite control CPU 91 performs control to display an image related to a game (for example, a bet screen 51) on the image display device 7. When the processing is terminated, the satellite control CPU 91 advances the processing to Step S450.

In Step S450, payout processing is performed. In this processing, the satellite control CPU 91 performs processing to pay out medals to a player based on the medal payout data from the roulette device 2 or to add the amount of credits. When the processing is terminated, the satellite control CPU 91 advances the processing to Step S410.

Figure 19:
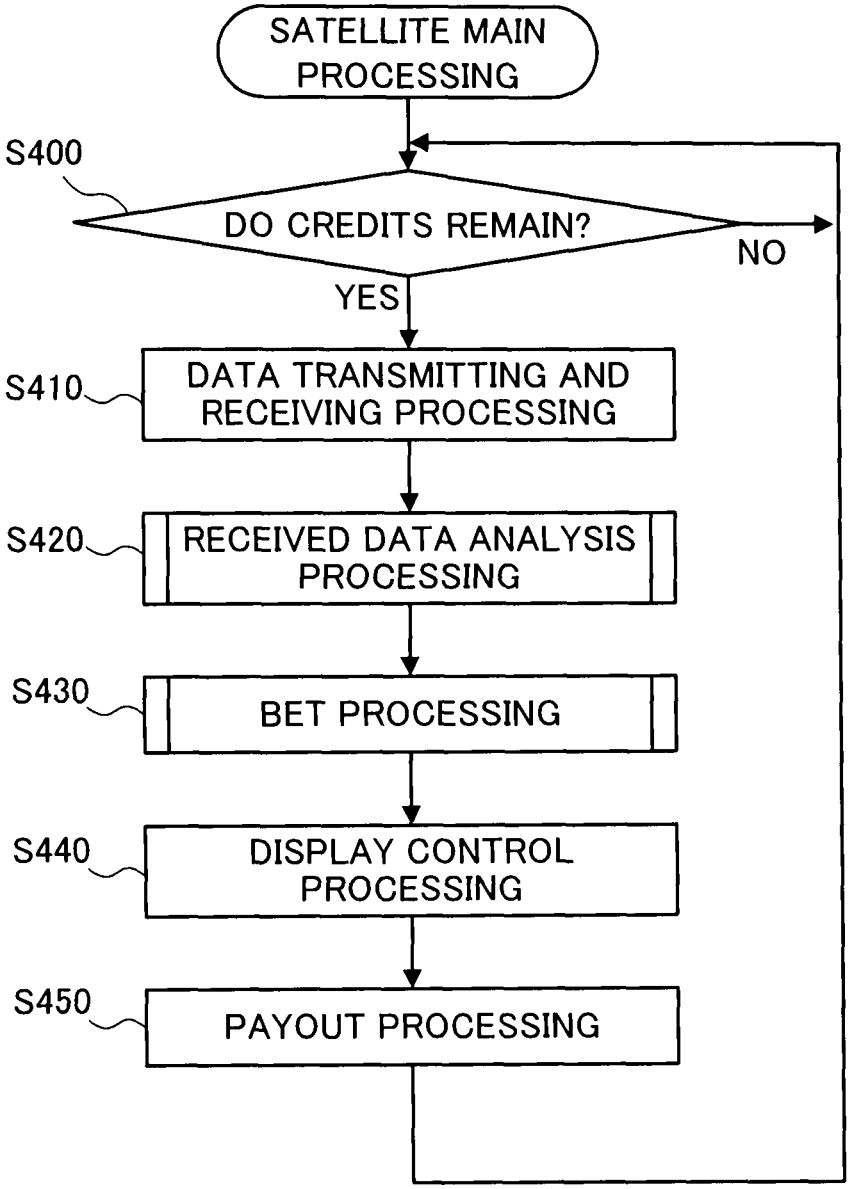
FIG. 19 is a flowchart showing control processing executed in a roulette game device according to the present embodiment.
Figure 20:
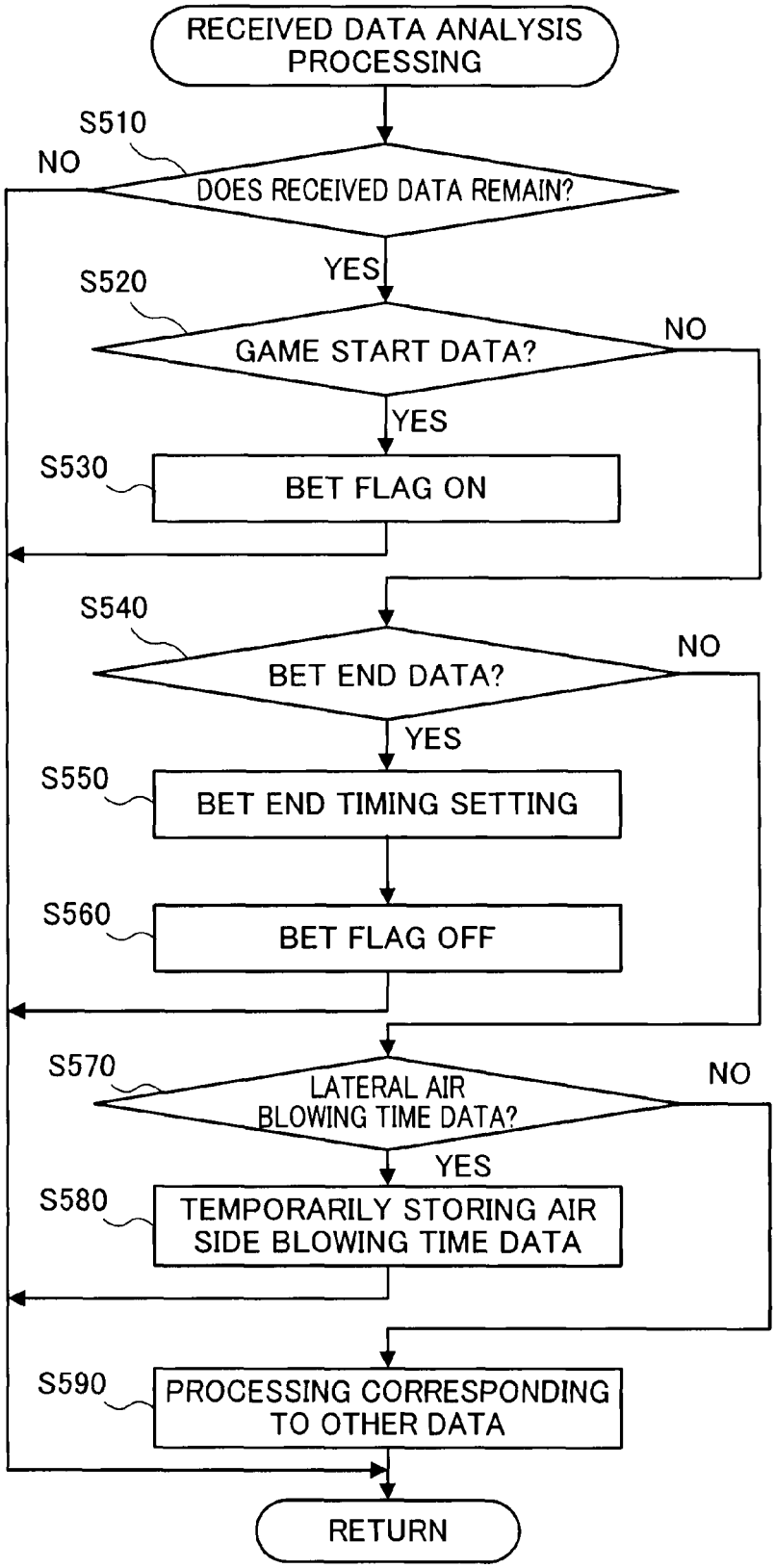
FIG. 20 is a flowchart showing control processing executed in a roulette game device according to the present embodiment.

Received data analysis processing of FIG. 19 is described with reference to FIG. 20.

In Step S510, the satellite control CPU 91 performs processing to determine whether data has been received from the roulette device 2. In a case in which it is determined to have been received, the satellite control CPU 91 advances the processing to Step S520. In a case in which it is not determined to not have been received, the satellite control CPU 91 ends the present sub routine.

In Step S520, the satellite control CPU 91 performs processing to determine whether the data thus received is game start data. In this processing, when the satellite control CPU 91 determines to have received the game start data, it advances the processing to Step S530. On the other hand, when the satellite control CPU 91 has not determined to have received the game start data, it advances the processing to Step S540.

In Step S530, the satellite control CPU 91 performs processing to set in the RAM 93 a value at which a bet flag turns on. When this processing is terminated, the satellite control CPU 91 ends the present sub routine.

In Step S540, processing to determine whether the data thus received is bet end timing data is performed. In this processing, when the satellite control CPU 91 determines to have received the bet end timing data, it advances the processing to Step S550. On the other hand, when the satellite control CPU 91 has not determined to have received the bet end timing data, it advances the processing to Step S570.

In Step S550, the satellite control CPU 91 performs processing to set a timing at which betting is actually ended based on lateral air blowing time data received from the roulette device 2. That is, regarding a waiting time corresponding to a random lateral air blowing time period, the blowing time period, for example, in a case of being in a range from 2.0 seconds to 2.5 seconds, corresponds to a waiting time in a range from 0 milliseconds to 800 milliseconds as shown in FIG. 24, and a time period with this waiting time added thereto is set as the actual bet end timing. When this processing is terminated, the satellite control CPU 91 advances the processing to Step S560.

In Step S560, in a case in which a timing at which betting is ended comes, the satellite control CPU 91 performs processing to set in the RAM 93 a value at which a get flag turns off. When this processing is terminated, the satellite control CPU 91 ends the present sub routine.

In Step S570, the satellite control CPU 91 performs processing to determine whether the data thus received is lateral air blowing time data. In this processing, in a case in which the satellite control CPU 91 determines to have received the lateral air blowing time data, it advances the processing to Step S580. On the other hand, in a case in which the satellite control CPU 91 has not determined to have received the lateral air blowing data, it advances the processing to Step S590.

In Step S580, the satellite control CPU 91 performs processing to temporarily store the lateral air blowing data in the RAM 93. This data is referenced in the processing of Step S550. When this processing is terminated, the satellite control CPU 91 ends the present sub routine.

In Step S590, the satellite control CPU 91 performs processing that corresponds to other data received. For example, in a case in which medal payout data has been received, a number of medals designated by the data to be paid out is set in the RAM 93. Then, the payout of medals to a player is performed by the processing of Step S450 of FIG. 19. It should be noted that the lateral air blowing time data which is temporarily stored in the RAM 93 is cleared when game end data is received from the roulette device 2. When this processing is terminated, the satellite control CPU 91 ends the present sub routine.

Figure 21:
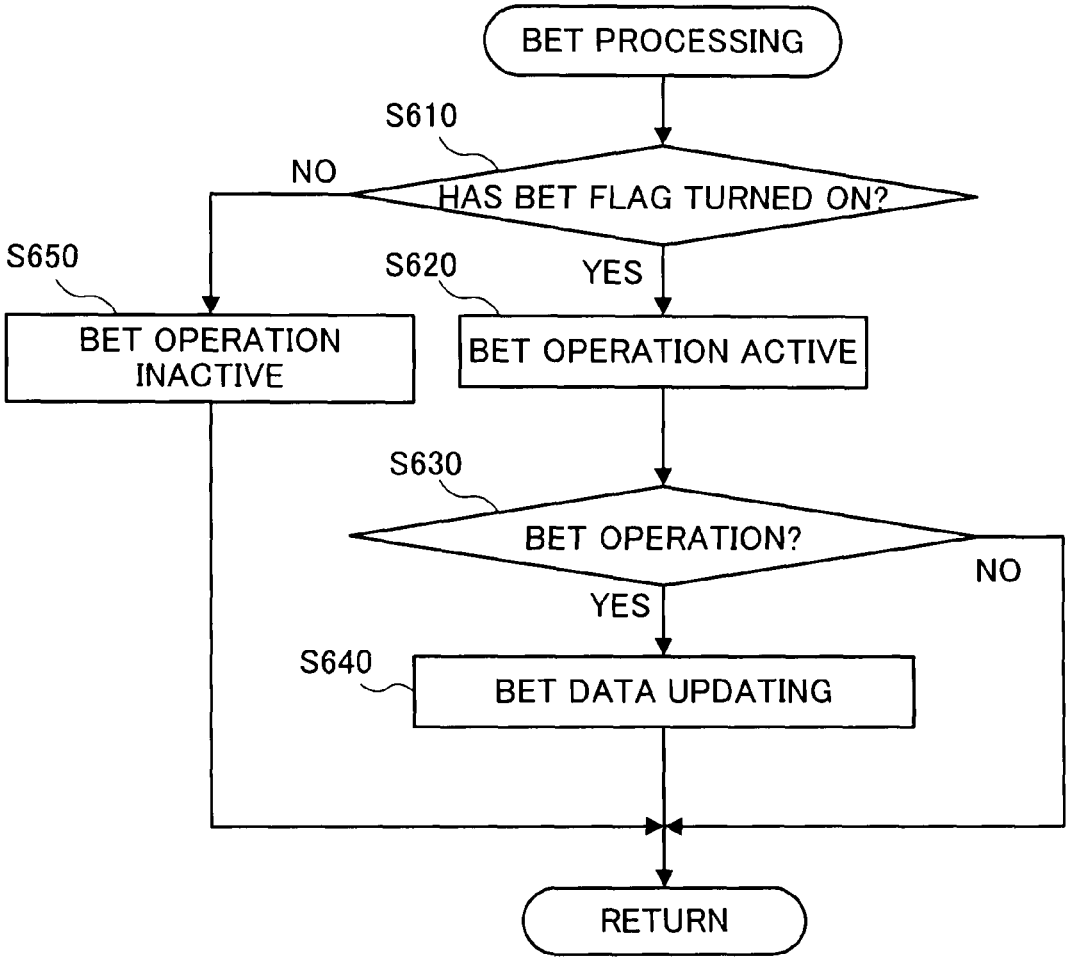
FIG. 21 is a flowchart showing control processing executed in a roulette game device according to the present embodiment.

Bet processing of FIG. 19 is described with reference to FIG. 21.

In Step S610, the satellite control CPU 91 performs processing to determine whether the bet flag is in an on state. In a case in which it is determined that the bet flag is in the on state, the satellite control CPU 91 advances the processing to Step S610. In a case in which it is not determined that the bet flag is in the on state, the satellite control CPU 91 advances the processing to Step S650.

In Step S620, the satellite control CPU 91 performs processing to make a bet operation active. That is, the satellite control CPU 91 makes active the operation by the touch panel 48 of the image display device 7. When this processing is terminated, the satellite control CPU 91 advances the processing to Step S630.

In Step S630, the satellite control CPU 91 performs processing to determine whether the bet operation has been performed. In a case in which it is determined that the bet operation has been performed, the satellite control CPU 91 advances the processing to Step S640. In a case in which it is not determined that the bet operation has been performed, the satellite control CPU 91 ends the present sub routine.

In Step S640, the satellite control CPU 91 performs processing to update the bet data stored in the RAM 93. It should be noted that the bet data stored in the RAM 93 is maintained in the RAM 93 as well as transmitted to the roulette device 2 by the processing in Step S410 of FIG. 19. When this processing is terminated, the satellite control CPU 91 ends the present sub routine.

In Step S650, the satellite control CPU 91 performs processing to make the bet operation inactive. That is, even if an operation is performed by the touch panel 48 of the image display device 7, a state is entered in which no detection signal of the operation is generated or in which the satellite control CPU 91 does not receive. When this processing is terminated, the satellite control CPU 91 ends the present sub routine.

Figure 22:
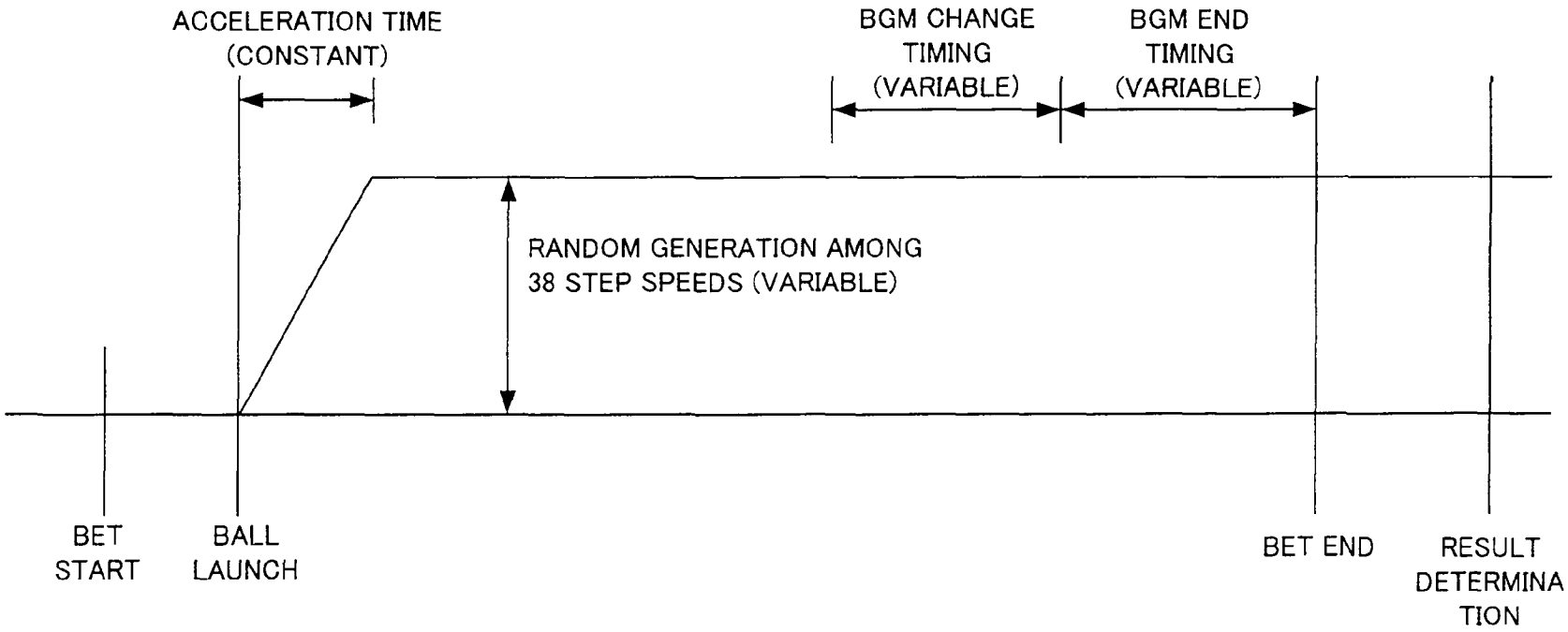
FIG. 22 is an illustrative diagram showing operation of a roulette game device according to the present embodiment.

Next, operations of the wheel 22 of the roulette game device 1 from bet start to game end are described with reference to FIG. 22. Here, a configuration is made in which, through the operation panel 32, BGM switching timing is set so as to be a time when the remaining number of revolutions becomes 5 revolutions and the bet end timing is set so as to be a point when the remaining number of revolutions becomes 1 revolution, respectively.

First, after the end of the previous roulette game, the bet operation is made effective and betting is started. Thereafter, after a predetermined time elapses (e.g., after 20 seconds), rotation of the wheel 22 is started by driving the drive motor 34, and the ball 11 is launched by running the compressor 14. At this time, the rotation speed of the wheel 22 is determined randomly from a speed among 37 steps. In addition, a lateral air blowing time period during ball launch, which is variable in each game, is determined randomly in 0.1 second units from a time period of 2.0 seconds to 2.5 seconds, whereby the ball 11 revolves on the bank path 29.

Thereafter, the revolution speed of the ball 11 becomes slower by stopping the compressor 14. Then, the revolution speed is monitored while predicting the remaining number of revolutions of the ball 11, and when the remaining number of revolutions is determined to be 5 revolutions, BGM is switched to a random timing (e.g., after 1 second) within 2 seconds from this determination time. Furthermore, after the remaining number of revolutions has been determined to be 1 revolution, betting is ended at a point when the waiting time, which was set according to the lateral air blowing time period, has elapsed.

Then, the ball 11 falls and is held in a predetermined pocket 23. The game result is determined based on the mark corresponding to this pocket 23, and in a case where a bet has been made on the mark corresponding to the pocket 23 in which the ball 11 is held, a number of medals corresponding to the bet terms is paid out to the player.

As explained above, according to the present embodiment, the timing at which a ball falls can be predicted by monitoring the revolution speed of the ball using a passing sensor (the ball revolution sensor 570 and the ball revolution sensor 580) provided in the bank path. In this way, it becomes possible to provide a roulette game device that allows betting until immediately before the ball falls.

In addition, it becomes possible to reduce a total game time for one game while maintaining the bet time by allowing betting until immediately before the ball falls. In this way, it is possible to perform more roulette games.

In addition, because it is possible to bet until immediately before the ball falls, predicting a game result can be made to seem easy since a bet can be made by waiting until immediately before the bet end timing when rotation of the ball has slowed down. Moreover, on the other hand, it becomes possible to impart an indeterminate effect on the game result and thus make prediction to win difficult by changing the rotation speed of the wheel 22 in each game, including a margin of 1 second, for example, in the bet end timing, randomly determining the end within this 1 second, and making the waiting time variable from the bet end timing determination to the actual bet end timing.

In addition, considering a case in which the rotation speed of the wheel 22 is not changed, for example, prediction becomes possible with high accuracy to some extent by collecting data corresponding to how many pockets the ball 11 advances from the pocket from which it was launched to the next pocket it falls. However, since the rotation speed of the wheel 22 changes in each game, the accuracy of a prediction using such a method is reduced. It should be noted that, in the present embodiment, although it is changed in 37 steps, this is configured with the object of allowing setting so that the number of pockets advanced is from 0 to 36.

Moreover, even for the lateral air-blowing time period during ball launch, in a case where the lateral air-blowing time period is the same every time, prediction becomes possible with high accuracy to some extent by collecting data corresponding to how many pockets the ball 11 advances from the pocket from which it was launched to the next pocket it falls. However, since the waiting period from bet end timing determination to actual bet end timing is variable according to the lateral air-blowing time period during ball launch, the precision of prediction by such a method is reduced.

In addition, since the remaining number of revolutions of the ball that brings about the bet end timing is set on the side of the amusement facility, for example, in the case of prediction of a game result to win becoming easy, by increasing the remaining number of revolutions and making the bet end timing earlier, it is possible to take measures to make prediction of a game result more difficult.

Furthermore, by taking the history of the time from ball launch to falling and having a learning function established that corrects a predicted value of the remaining number of revolutions according to an amount of change in falling timing, for example, even if the outer circumference of the wheel 22 becomes dirty and the revolution speed of the ball 11 changes, it is possible to correctly predict the remaining number of revolutions of the ball 11.

In addition, by randomizing the BGM switching timing at which the fact that bet end timing is soon is notified, it becomes difficult to predict a game result based on BGM switching timing, and thus it is possible to provide a rendered game that cannot be easily won.

What is claimed is:

1. A roulette game device comprising:

a roulette wheel on which a plurality of marks is disposed;

a ball that rolls on the roulette wheel;

a plurality of pockets formed on the roulette wheel in a circumferential direction thereof to correspond to the plurality of marks, and in which the ball falls;

a bet device that bets a chip, by way of a player operation, on a plurality of bet areas that respectively correspond to the plurality of marks; and a controller that controls the roulette game device, a bank path on which the ball revolves;

a compressor that compresses air; and a discharge opening that discharges air that has been compressed by the compressor along a revolution direction of the ball on the bank path, wherein the controller performs control to eject air from the discharge opening to the ball, to change an ejection time of air onto the ball in each execution of a roulette game, and to randomly determine, within a fixed time range, an end of a bet operation in each execution of the roulette game, and wherein the end of the bet operation is delayed by a waiting time, and the waiting time is randomly determined by the ejection time.

2. The roulette game device according to claim 1, wherein the bank path is provided to be endless and surround an outer circumferential edge side relative to the pockets of the roulette wheel.

3. The roulette game device according to claim 1, wherein the controller performs control to delay the end of the bet operation in response to the ejection time.

4. The roulette game device according to claim 1, wherein the controller performs control to arbitrarily change a rotation speed of the roulette wheel within a fixed speed range in each execution of the roulette game.

5. A roulette game device comprising:

a roulette wheel on which a plurality of marks is disposed;

a ball that rolls on the roulette wheel;

a plurality of pockets formed on the roulette wheel in a circumferential direction thereof to correspond to the plurality of marks, and in which the ball falls;

a bank path that is provided to be endless and surround an outer circumferential edge side relative to the pockets of the roulette wheel, and on which the ball revolves;

a bet device that bets a chip, by way of an operation of a player, on a plurality of bet areas that respectively correspond to the plurality of marks;

a detection sensor that detects the ball revolving around the bank path; and a controller that controls the roulette game device, wherein the ball is revolved by an air blowing, and wherein the controller randomly determines a waiting time by randomly determining a time period of the air blowing, the waiting time being determined by the time period of the air blowing, performs control to determine an end timing based on a revolution speed of the ball from detection results of the detection sensor, and sets a timing at which a bet operation of the bet device is ended to a timing that is delayed by the waiting timing from the end time.

6. The roulette game device according to claim 5, wherein the controller estimates a remaining number of revolutions until a state is entered in which the ball easily moves from the bank path to a side of the roulette wheel, based on the revolution speed of the ball, and determine a timing when the remaining number of revolutions becomes a predetermined number of times as the end timing.

7. The roulette game device according to claim 6, further comprising an input device that designates the predetermined number of times by way of an external operation.

8. The roulette game device according to claim 5, wherein the controller performs control to store data related to the revolution speed in memory, each execution of a roulette game, to request a temporal change of the revolution speed based on data stored in the memory, and to adjust the end timing of the bet operation according to the temporal change of the revolution speed.

9. The roulette game device according to claim 5, wherein the controller performs control to arbitrarily change, within a fixed time range that begins a predetermined time before the end timing of the bet operation, a timing to begin a notification that the end timing of the bet operation is soon in each execution of a roulette game, when performing control to perform the notification.

10. The roulette game device according to claim 1, wherein the controller randomly determines the ejection time within a fixed ejection time range.

* * * * *